US011828566B1

(12) United States Patent
Hansen et al.

(10) Patent No.: US 11,828,566 B1
(45) Date of Patent: Nov. 28, 2023

(54) BOW CONVERTIBLE BETWEEN A LEFT HANDED AND A RIGHT HANDED CONFIGURATION

(71) Applicant: Precision Shooting Equipment, Inc., Tucson, AZ (US)

(72) Inventors: Kevin L Hansen, Jefferson City, MT (US); David Alan McNealy, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 17/885,223

(22) Filed: Aug. 10, 2022

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01)

(58) Field of Classification Search
CPC ..... F41B 5/10; F41B 5/14; F41B 5/1403
USPC ..... 124/25.6, 86, 88
See application file for complete search history.

(56) References Cited

U.S. PATENT DOCUMENTS 4,494,521 A * 1/1985 Quartino ..... F41B 5/10 124/23.1
4,759,337 A * 7/1988 Suski ..... F41B 5/143 124/44.5
5,099,819 A * 3/1992 Simonds ..... F41B 5/10 124/88
5,205,268 A * 4/1993 Savage ..... F41B 5/14 124/44.5
5,243,957 A * 9/1993 Neilson ..... F41B 5/1469 124/31
5,280,779 A * 1/1994 Smith ..... F41B 5/0026 124/88
5,464,001 A * 11/1995 Peck ..... F41B 5/10 124/88
5,592,929 A * 1/1997 Hoyt, Jr. ..... F41B 5/0005 124/88
5,697,358 A * 12/1997 Campisi ..... F41B 5/10 124/88
RE37,544 E * 2/2002 Darlington ..... F41B 5/10 124/900
6,371,098 B1 * 4/2002 Winther ..... F41B 5/10 124/44.5
6,715,481 B1 * 4/2004 Anderson ..... F41B 5/143 124/90
6,758,204 B1 * 7/2004 Goff ..... F41B 5/10 124/25.6
7,066,165 B2 * 6/2006 Perry ..... F41B 5/10 124/88

(Continued)

OTHER PUBLICATIONS

Recurve Bow Owner's Manual, p. 1-21, Hoyt USA, www.hoytusa.com (admitted prior art).
Compound Bow User's Guide, p. 1-16, www.PSE-Archery.com (2018).

*Primary Examiner* — Alexander R Niconovich
(74) *Attorney, Agent, or Firm* — Merchant & Gould P.C.

(57) ABSTRACT

The present disclosure relates to a compound bow that can be converted between a left handed bow configuration and a right handed bow configuration. The compound bow has pockets that are moveable relative to the riser between a left handed mounting configuration in which left handed side-load compensation is provided and a right handed mounting configuration in which right handed sideload compensation is provided.

17 Claims, 26 Drawing Sheets

(56) References Cited

U.S. PATENT DOCUMENTS 7,743,760 B2 * 6/2010 Woodland ..... F41B 5/0094 124/25
7,784,452 B1 * 8/2010 Kronengold ..... F41B 5/10 124/23.1
8,347,869 B2 * 1/2013 Sims ..... F41B 5/14 124/23.1
8,522,762 B2 * 9/2013 Trpkovski ..... F41B 5/1453 124/900
8,622,050 B2 * 1/2014 Goff ..... F41B 5/12 124/35.2
8,671,923 B2 * 3/2014 Goff ..... F41B 5/1469 124/25
8,844,508 B2 * 9/2014 Sims ..... F41B 5/123 124/25
9,140,513 B2 * 9/2015 Trpkovski ..... F41B 5/0031
9,273,921 B2 * 3/2016 Koch ..... F41B 5/10
9,354,016 B2 * 5/2016 Trpkovski ..... F41B 5/0031
9,389,039 B2 * 7/2016 Denton ..... F41B 5/10
9,683,806 B1 * 6/2017 Yehle ..... F41B 5/105
10,527,382 B2 * 1/2020 Trpkovski ..... F41B 5/10
10,704,857 B2 * 7/2020 Ozanne ..... F41B 5/10
10,883,791 B2 * 1/2021 Webster ..... F41B 5/0005
11,181,334 B2 * 11/2021 Sidebottom ..... F41B 5/1403
11,268,780 B2 * 3/2022 Stanziale ..... F41B 5/105
11,668,543 B2 * 6/2023 Sidebottom ..... F41B 5/1403 124/88
2011/0303205 A1 * 12/2011 Goff ..... F41B 5/12 124/31
2013/0269672 A1 * 10/2013 McPherson ..... F41B 5/1403 124/88
2014/0261354 A1 * 9/2014 Ross, Jr. ..... F41B 5/143 124/88
2021/0222988 A1 * 7/2021 Webster ..... F41B 5/0026

* cited by examiner

BOW CONVERTIBLE BETWEEN A LEFT HANDED AND A RIGHT HANDED CONFIGURATION

TECHNICAL FIELD

The present disclosure relates generally to archery equipment. More particularly, the present disclosure relates to compound bows.

BACKGROUND

A typical compound bow includes a riser (i.e., a handle) and resilient limbs attached to opposite ends of the riser by pockets. Cams are mounted at free ends of the limbs and tensioning cables as well as a bow string are routed between the cams. Limb bolts are used to pivot the pockets relative to the riser to tension the tensioning cables and to set a string draw weight of the bow.

Bow manufacturers provide right handed and left handed compound bows to accommodate the needs of both right handed and left handed archers. Generally, right handed bows and left handed bows have risers with different configurations. To promote product manufacturing and distribution efficiency, there are benefits to reducing the number of different components in a bow product line.

SUMMARY

One aspect of the present disclosure relates to a compound bow that can be converted between a left handed bow configuration and a right handed bow configuration. In one example, the compound bow is a shoot-through bow having a riser defining a central opening through which arrows are shot. In one example, the compound bow has pockets that are moveable relative to the riser between a left handed mounting configuration in which left handed sideload compensation is provided and a right handed mounting configuration in which right handed sideload compensation is provided.

Another aspect of the present disclosure relates to a bow configurable in a left handed bow configuration and a right handed bow configuration. The bow includes a riser having an upper end, a lower end, a front side, a rear side, a left side and a right side. The bow also includes upper and lower limb arrangements having base ends and free ends. The base ends of the upper limb arrangement attach to the upper end of the riser and the base ends of the lower limb arrangement attach to the lower end of the riser. The bow further includes an upper cam supported by the free ends of the upper limb arrangement and a lower cam supported by the free ends of the lower limb arrangement. The upper and lower cams are configured to engage a bow string and tensioning cables. When the bow is configured in the left handed bow configuration, the tensioning cables and the upper and lower cams apply a leftward sideload to the free ends of the upper and lower limb arrangements when the bow is tensioned. When the bow is configured in the right handed bow configuration, the tensioning cables and the upper and lower cams apply a rightward sideload to the free ends of the upper and lower limb arrangements when the bow is tensioned. The bow further includes upper and lower limb pockets that respectively mount to the upper and lower ends of the riser for attaching the base ends of the upper and lower limb arrangements to the upper and lower ends of the riser. The upper and lower limb pockets each are mountable to the riser in a left handed mounting configuration when the bow is set in the left handed bow configuration and a right handed mounting configuration when the bow is set in the right handed bow configuration. When the upper and lower limb pockets are mounted to the riser in the left handed mounting configuration, the base ends of the upper and lower limb arrangements are angled in a leftward direction relative to the riser to provide rightward position compensation at the free ends of the upper and lower limb arrangements that compensates for the leftward sideload applied to the free ends of the upper and lower limb arrangements when the bow is tensioned while in the left handed bow configuration. When the upper and lower limb pockets are mounted to the riser in the right handed mounting configuration, the base ends of the upper and lower limb arrangements are angled in a rightward direction relative to the riser to provide leftward position compensation at the free ends of the upper and lower limb arrangements that compensates for the rightward sideload applied to the free ends of the upper and lower limb arrangements when the bow is tensioned while in the right handed bow configuration.

A further aspect of the present disclosure relates to a bow including a riser having an upper end, a lower end, a front side, a rear side, a left side and a right side. The riser defines an anchor opening that extends through the riser along a lateral orientation that extends from the left side to the right side. The riser is bisected by a central reference plane that intersects the front and rear sides and is centered between the left and right sides. The bow also includes upper limbs having base ends that attach to the upper end of the riser and free ends at which a cam is mounted for engaging a bow string. The bow also includes an upper limb pocket that mounts to the upper end of the riser for attaching the upper limbs to the upper end of the riser. The upper limb pocket is configured to receive the base ends of the upper limbs. The bow further includes a pivot axle that extends through the riser along the lateral orientation. The pivot axle is configured for pivotally connecting the upper limb pocket to the riser and for allowing pivotal movement of the upper limb pocket relative to the riser to adjust a draw weight of the bow. The upper limb pocket defines a limb bolt opening that is downwardly offset from the pivot axle. The bow additionally includes an anchor that mounts in the anchor opening. The anchor includes a main body defining an internally threaded opening. The anchor also includes a flange at one end of the main body. The anchor is mountable within the anchor opening in a first anchor mounting configuration in which the flange opposes the left side of the riser and a centerline of the internally threaded opening is leftwardly offset from the central reference plane of the riser. The anchor also is mountable within the anchor opening in a second anchor mounting configuration in which the flange opposes the right side of the riser and the internally threaded opening is rightwardly offset from the central reference plane of the riser. The bow further includes a limb bolt that extends through the limb bolt opening of the upper limb pocket and threads into the threaded opening of the anchor for setting a pivot position of upper limb pocket about the pivot axis. The anchor is mounted in the first anchor mounting configuration when it is desired to set the bow in a left handed bow configuration, and the anchor is mounted in the second anchor mounting configuration when it is desired to set the bow in a right handed bow configuration.

DETAILED DESCRIPTION

Figure 1:
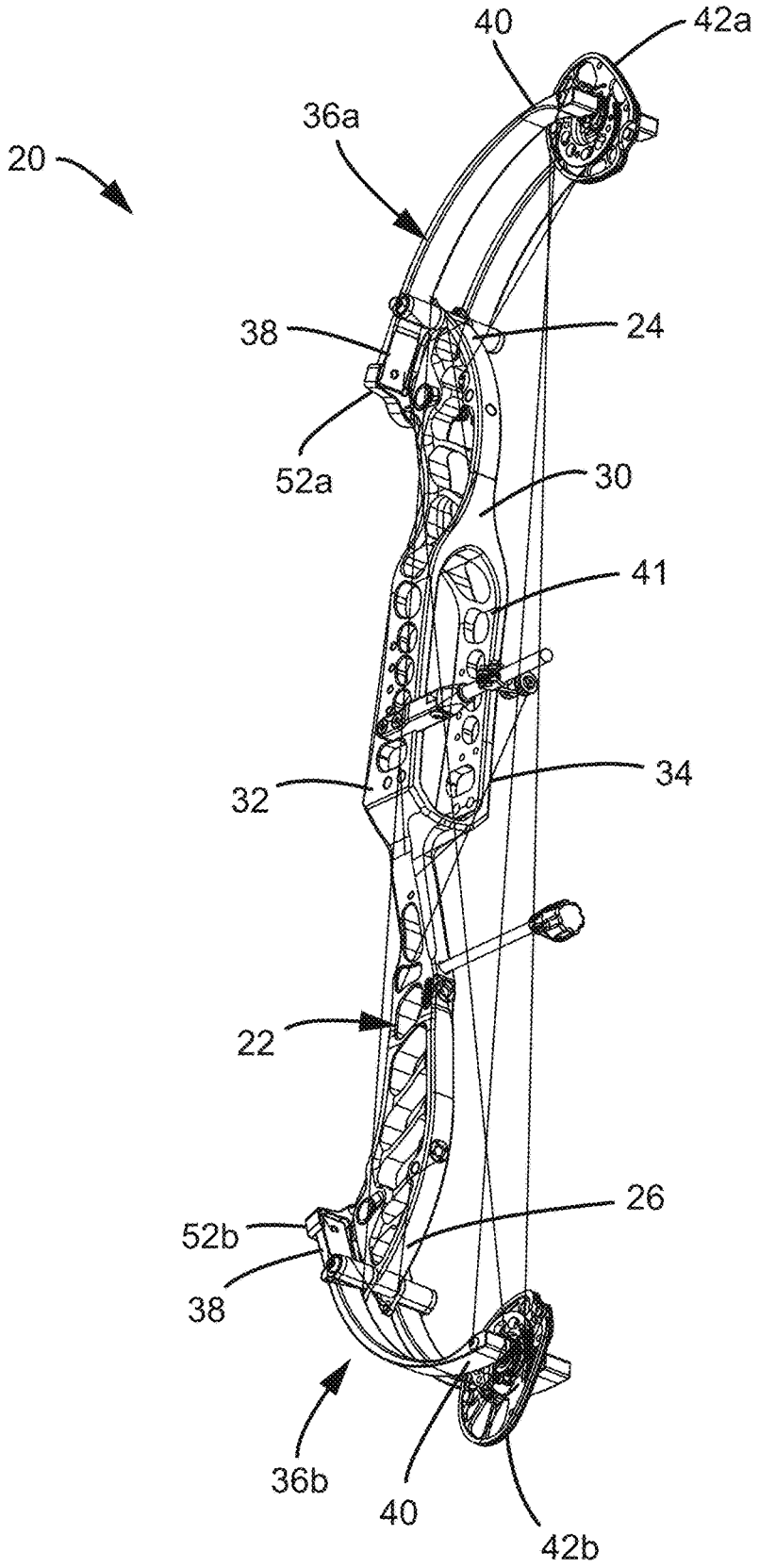
FIG. 1 is a rear, left side perspective view of a compound bow in accordance with the principles of the present disclosure assembled in a left handed bow configuration.
Figure 2:
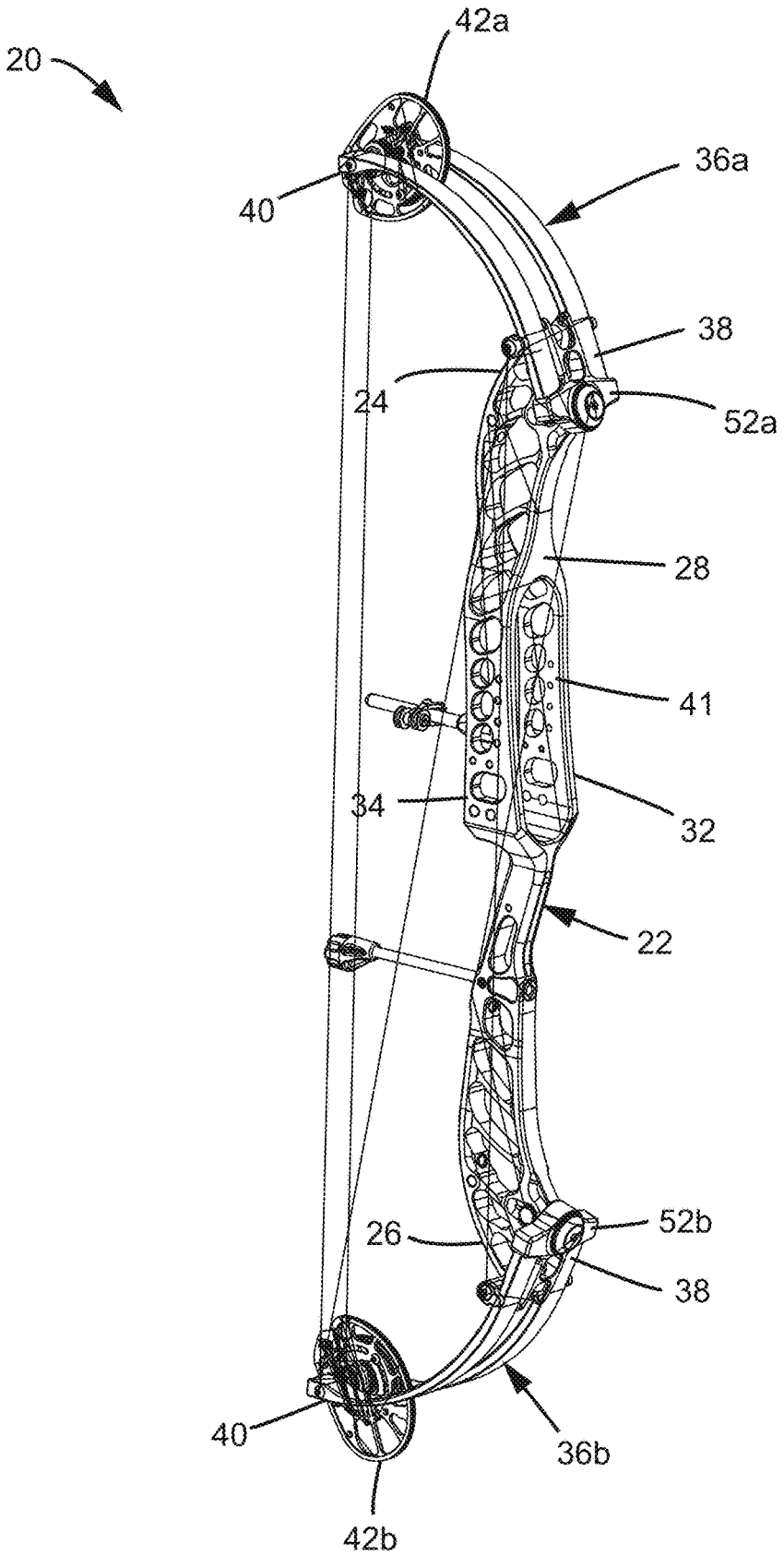
FIG. 2 is a front, right side perspective view of the compound bow of FIG. 1 assembled in the left handed bow configuration.

The present disclosure relates to a compound bow 20 configurable in a left handed bow configuration (see FIGS. 1-4) and a right handed bow configuration (see FIGS. 5-8). As depicted the compound bow 20 is a shoot-through bow.

The bow includes a riser 22 (i.e., a handle) having an upper end 24, a lower end 26, a front side 28, a rear side 30, a left side 32 and a right side 34. The bow 20 also includes upper and lower limb arrangements 36*a*, 36*b* having base ends 38 and free ends 40. The base ends 38 of the upper limb arrangement 36*a* attach to the upper end 24 of the riser 22 and the base ends 38 of the lower limb arrangement 36*b* attach to the lower end 26 of the riser 22. The bow 20 further includes an upper cam 42*a* supported by the free ends 40 of the upper limb arrangement 36*a* and a lower cam 42*b* supported by the free ends 40 of the lower limb arrangement 36*b*. The riser 22 defines a central opening 41 through which arrows are shot.

Figure 3:
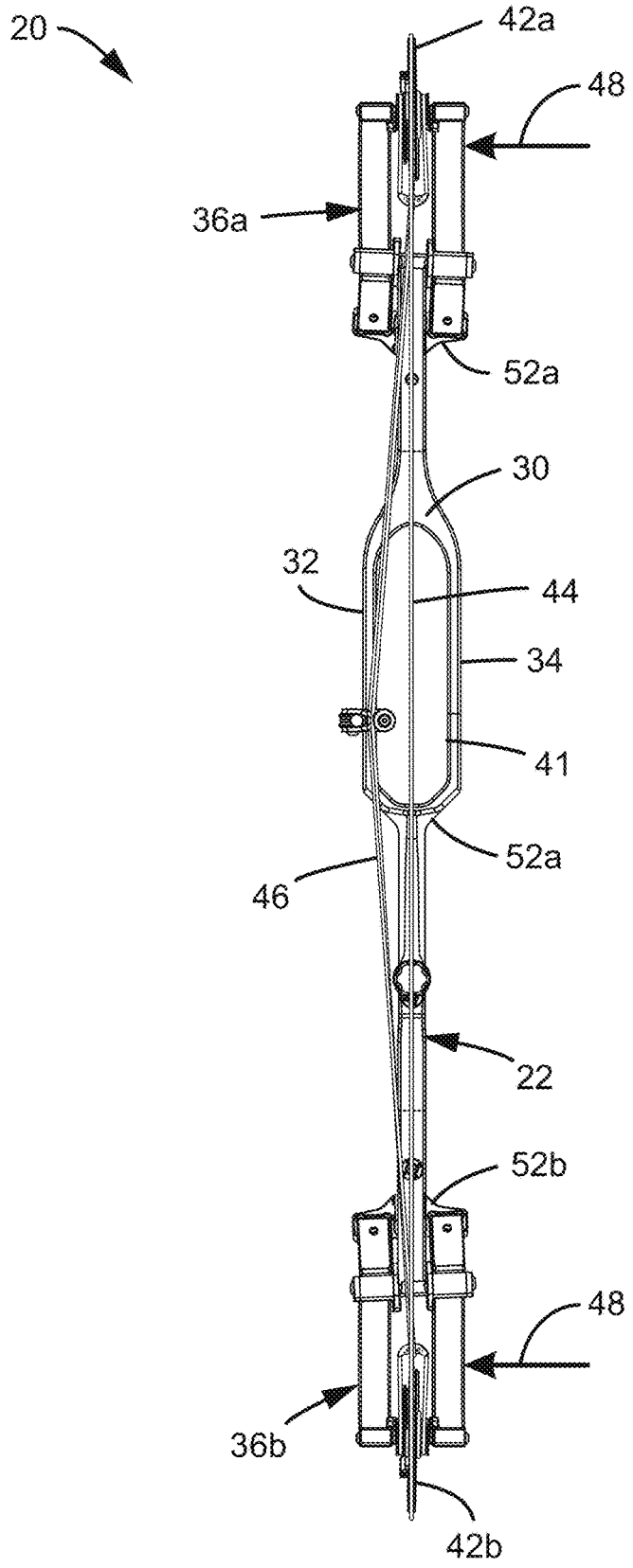
FIG. 3 rear view of the compound bow of FIG. 1 assembled in the left handed bow configuration with annotation added to show a direction of leftward sideloading applied by tensioning cables of the bow; pocket angling and limb deformation are exaggerated for illustration purposes.
Figure 7:
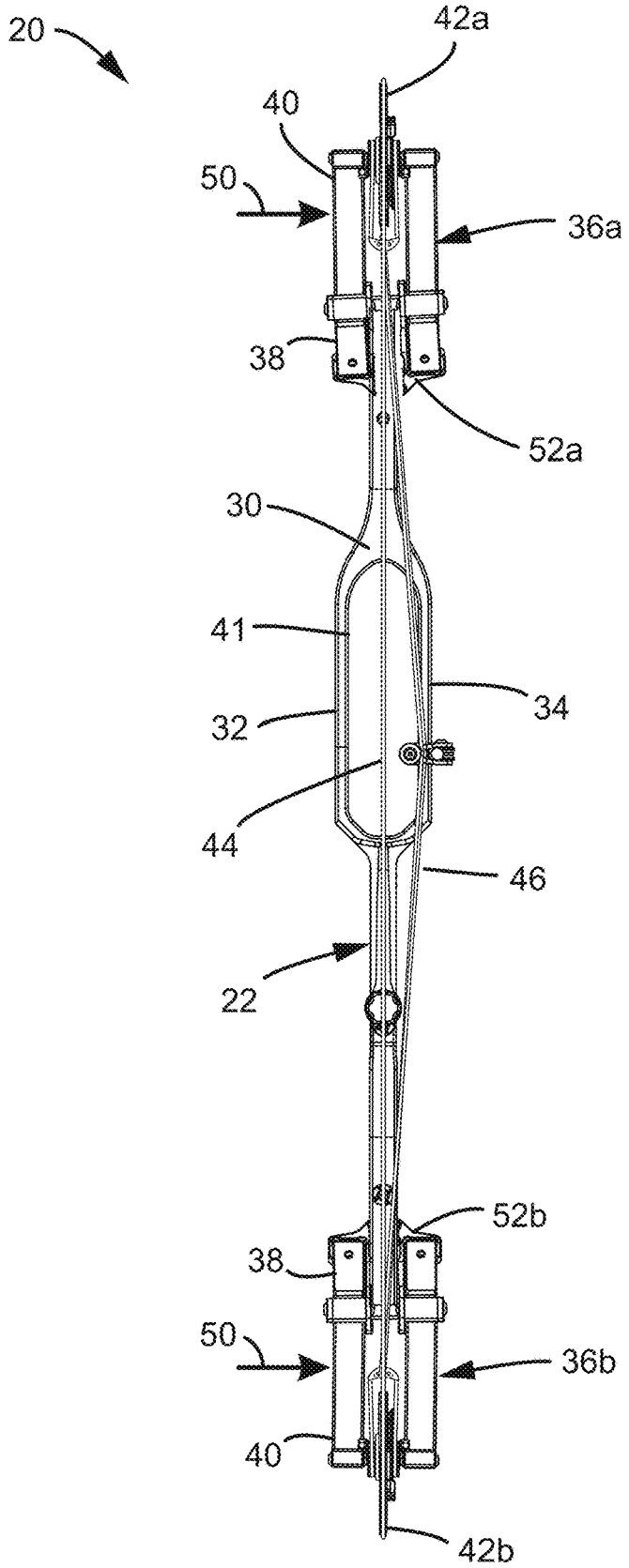
FIG. 7 rear view of the compound bow of FIG. 1 assembled in the right handed bow configuration with annotation added to show a direction of rightward sideloading applied by tensioning cables of the bow; pocket angling and limb deformation are exaggerated for illustration purposes.

The upper and lower cams 42*a*, 42*b* are configured to engage a bow string 44 (see FIGS. 3 and 7) and tensioning cables 46 (see FIGS. 3 and 7). When the bow 20 is configured in the left handed bow configuration as shown at FIG. 3, the tensioning cables 46 and the upper and lower cams 42*a*, 42*b* apply a leftward sideload 48 to the free ends 40 of the upper and lower limb arrangements 36*a*, 36*b* when the bow 20 is tensioned. The leftward sideload 48 is caused by leftward routing of the tensioning cables 46 relative to a centerline of the riser 22 to prevent the tensioning cables 46 from interfering with an arrow when the arrow is shot. In the left handed bow configuration, a bow sight is mounted at the left side of the riser 22.

When the bow 20 is configured in the right handed bow configuration as shown at FIG. 7, the tensioning cables 46 and the upper and lower cams 42*a*, 42*b* apply a rightward sideload 50 to the free ends 40 of the upper and lower limb arrangements 36*a*, 36*b* when the bow is tensioned. The rightward sideload 50 is caused by rightward routing of the tensioning cables 46 relative to a centerline of the riser 22 to prevent the tensioning cables 46 from interfering with an arrow when the arrow is shot. In the right handed bow configuration, a bow sight is mounted at the right side of the riser 22.

Figure 11:
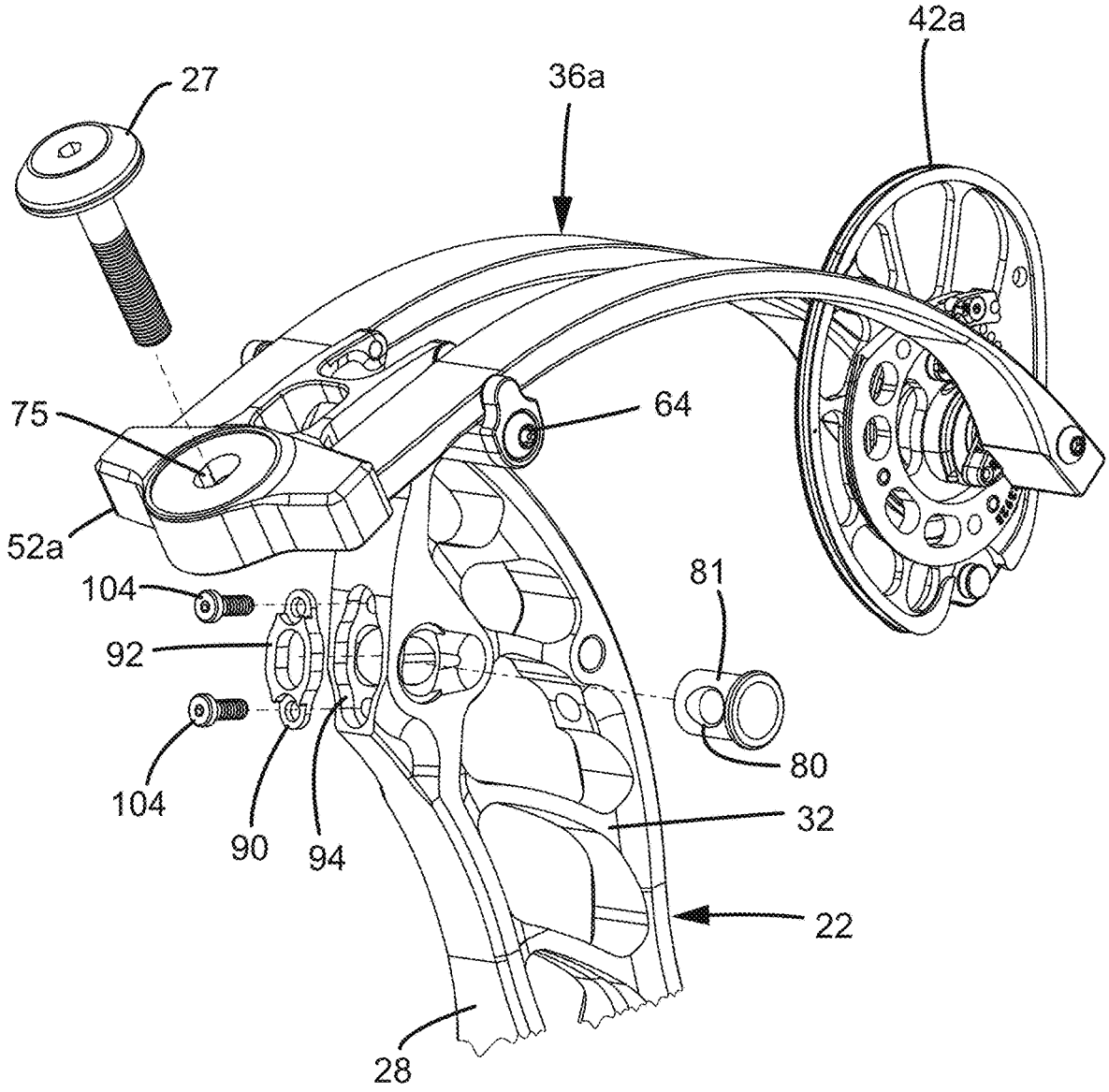
FIG. 11 is an exploded view of an upper limb pocket mounting assembly of the compound bow of FIG. 1 arranged for mounting an upper limb pocket to an upper end of the riser in the left handed mounting configuration.
Figure 16:
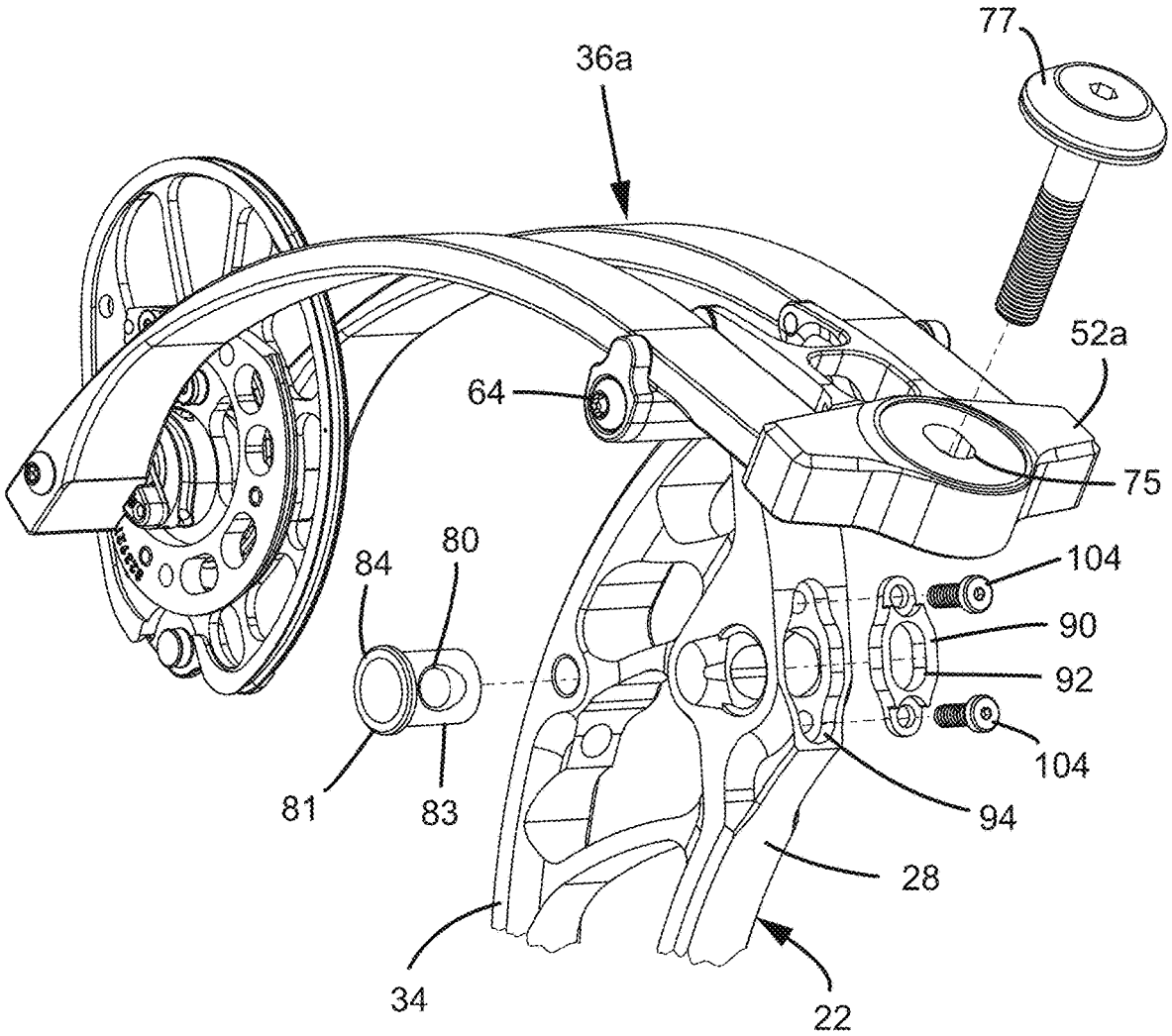
FIG. 16 is an exploded view of the upper limb pocket mounting assembly of the compound bow of FIG. 5 arranged for mounting an upper limb pocket to the upper end of the riser in the right handed mounting configuration.

The bow 20 further includes upper and lower limb pockets 52*a*, 52*b* that respectively mount to the upper and lower ends 24, 26 of the riser 22 for attaching the base ends 38 of the upper and lower limb arrangements 36*a*, 36*b* to the upper and lower ends 24, 26 of the riser 22. The upper and lower limb pockets 52*a*, 52*b* can be secured to the upper and lower ends 24, 26 of the riser 22 by upper and lower limb pocket mounting assemblies (the upper limb pocket mounting assemblies are best depicted at FIGS. 11 and 16). The upper and lower limb pockets 52*a*, 52*b* can include identical constructions. Also, the upper and lower limb arrangements 36*a*, 36*b* can have identical constructions. Further, the upper and lower cams 42*a*, 42*b* as well as the upper and lower limb pocket mounting assemblies can have identical constructions. For the sake of brevity, only the upper limb pocket mounting assembly for attaching the upper limb pocket 52*a* and the upper limb arrangement 36*a* to the upper end 24 of the riser 22 will be depicted in detail. It will be appreciated that such depiction and the related description is also applicable for attaching the lower limb pocket 52*b* and the lower limb arrangement 36*b* to the lower end 26 of the riser 22.

Figure 4:
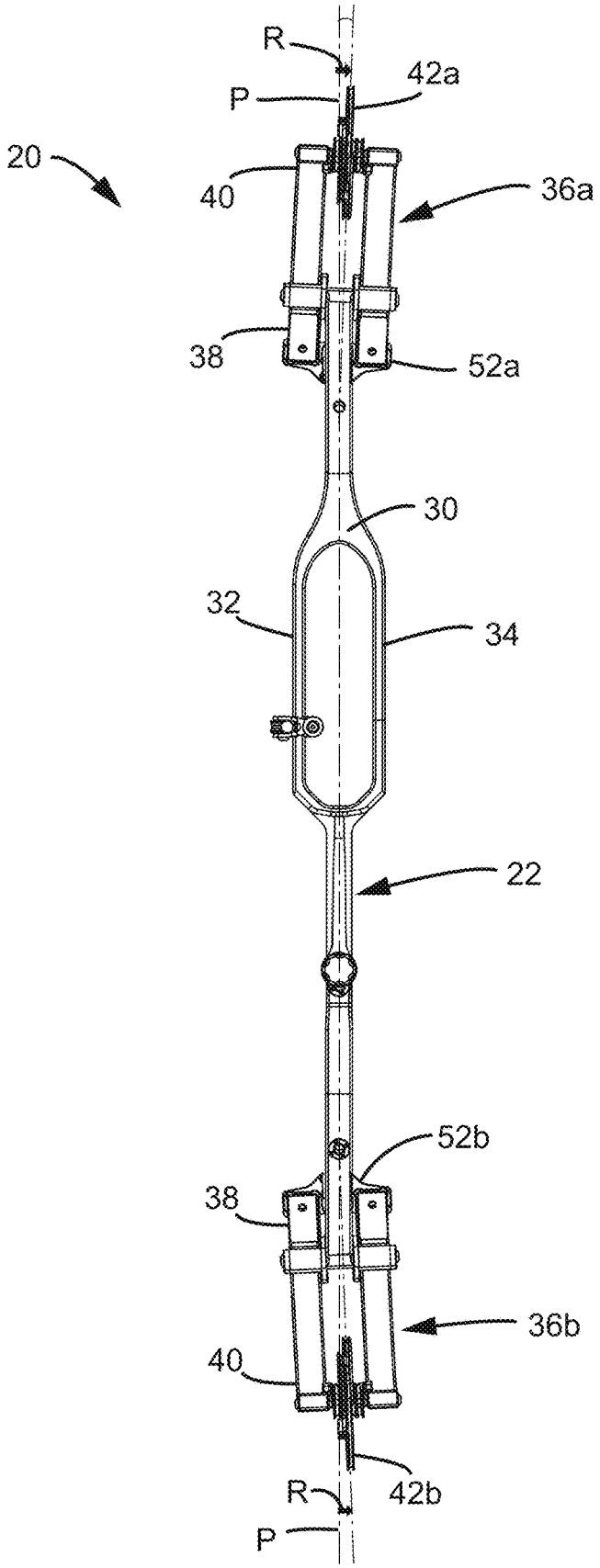
FIG. 4 is a rear view of the compound bow of FIG. 1 prior to the bow being tensioned with limb pockets of the bow assembled to a riser of the bow in a left handed mounting configuration in which limbs of the bow are angled to compensate for the leftward sideloading which will be applied during tensioning of the bow, the angling of the pockets and limbs is exaggerated for illustration purposes.
Figure 5:
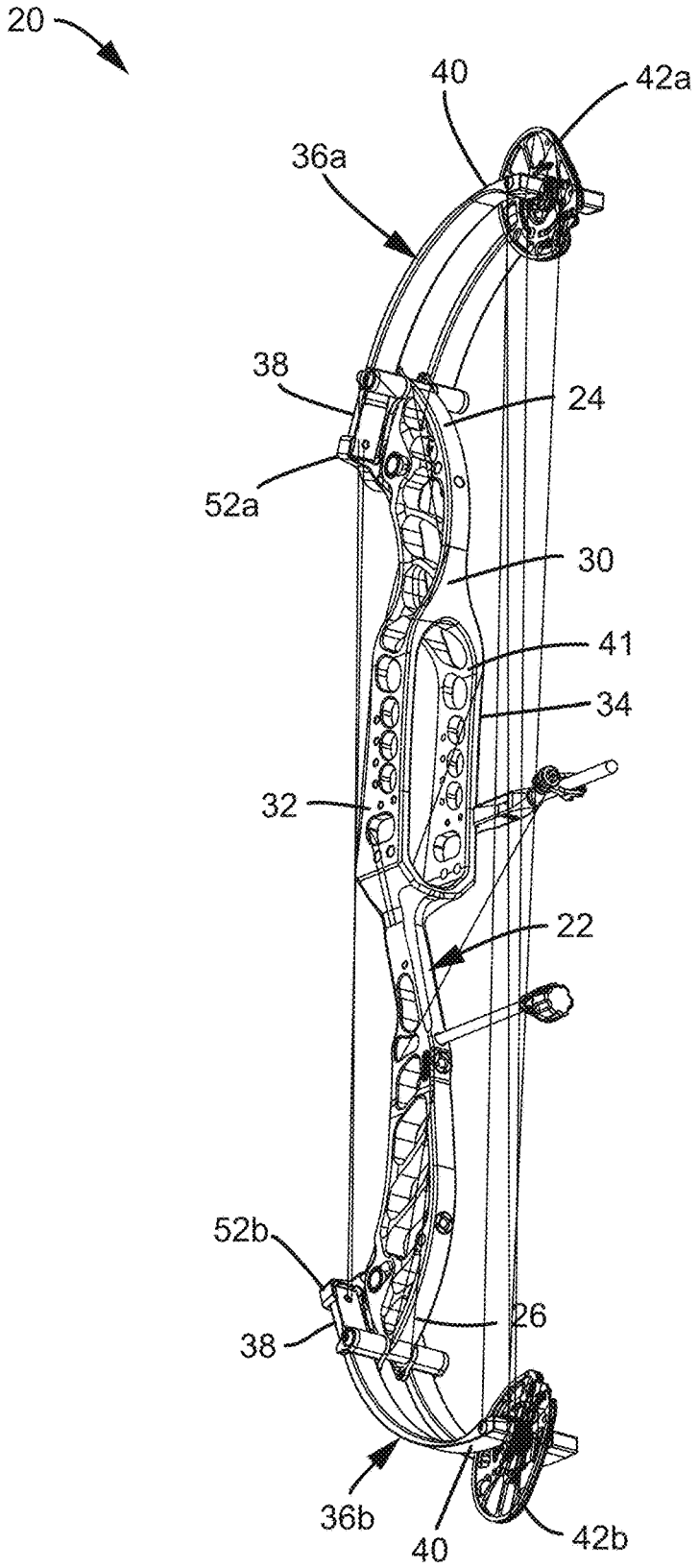
FIG. 5 is a rear, left side perspective view of the compound bow of FIG. 1 assembled in a right handed bow configuration.
Figure 6:
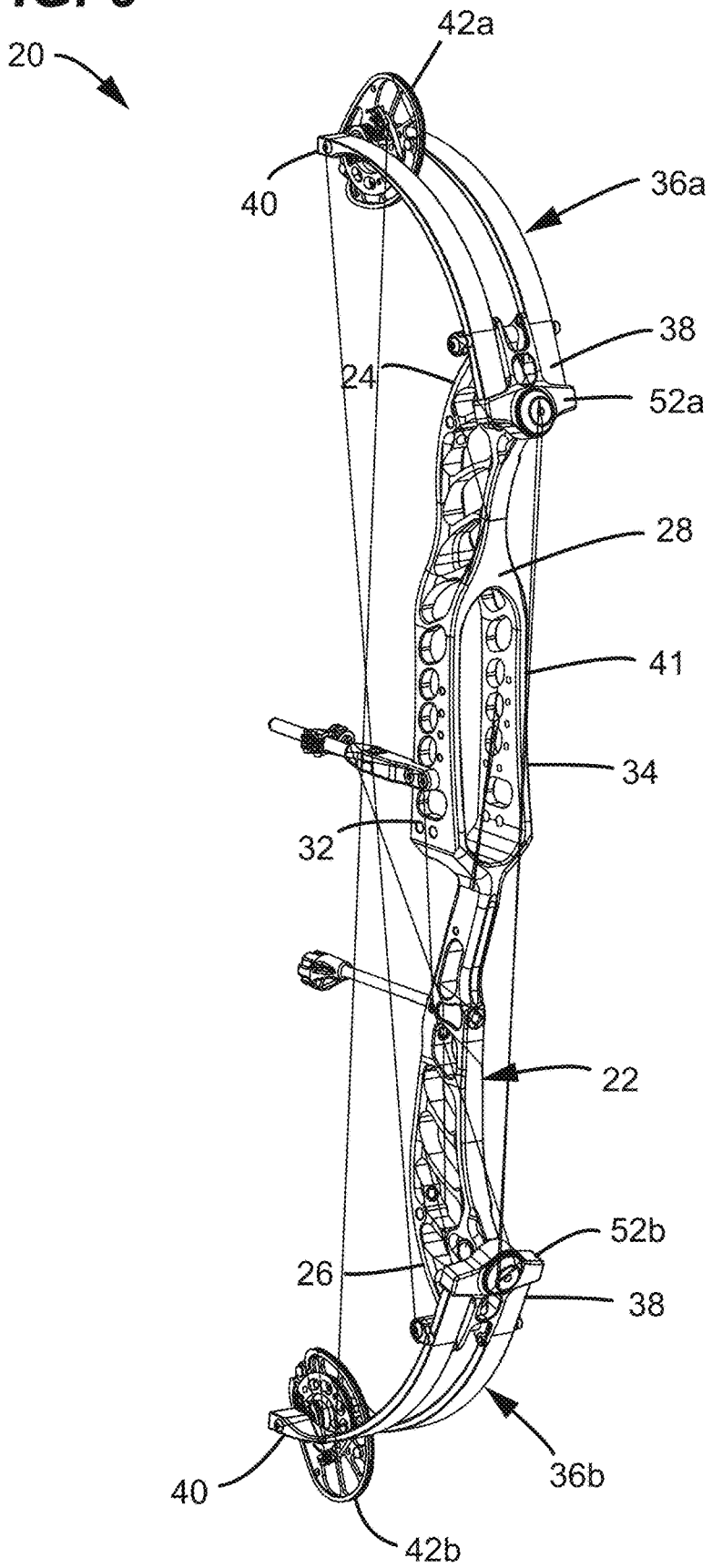
FIG. 6 is a front, right side perspective view of the compound bow of FIG. 1 assembled in the right handed bow configuration.

The upper and lower limb pockets 52*a*, 52*b* each are mountable to the riser 22 in a left handed mounting configuration (see FIG. 3) when the bow 20 is set in the left handed bow configuration of FIGS. 1-4 and a right handed mounting configuration (see FIG. 7) when the bow 20 is set in the right handed bow configuration of FIGS. 5-8. When the upper and lower limb pockets 52*a*, 52*b* are mounted to the riser in the left handed mounting configuration as shown at FIG. 4, the base ends 38 of the upper and lower limb arrangements 36*a*, 36*b* are angled in a leftward direction relative to the riser 22 to provide rightward position compensation R (e.g., rightward of a center reference plane P that bisects the riser 22) at the free ends 40 of the upper and lower limb arrangements 36*a*, 36*b*. The center reference plane P can coincide with a centerline of the riser 22 and can be oriented to intersect the front and rear sides 28, 30 of the riser 22 and to be centered between the left and right sides 32, 34 of the riser 22. FIG. 4 shows the bow 20 prior to tensioning of the bow 20 with the rightward position compensation R being adapted to compensate for the leftward sideload 48 applied to the free ends 40 of the upper and lower limb arrangements 36*a*, 36*b* when the bow 20 is tensioned while in the left handed bow configuration. The rightward position compensation R is provided such that upon tensioning of the bow, leftward deflection of the upper and lower limb arrangements 36*a*, 36*b* caused by the leftward sideload 48 brings the bow string 44 into general alignment with the center reference plane P and the centerline of the riser 22 as shown at FIG. 3. It will be appreciated that the angling of the upper and lower limb arrangements 36*a*, 36*b* and the size of the rightward position compensation R are exaggerated as shown at FIG. 4 for illustration purposes. In actual practice, the rightward position compensation R can be in the neighborhood of 0.06 inches.

Figure 8:
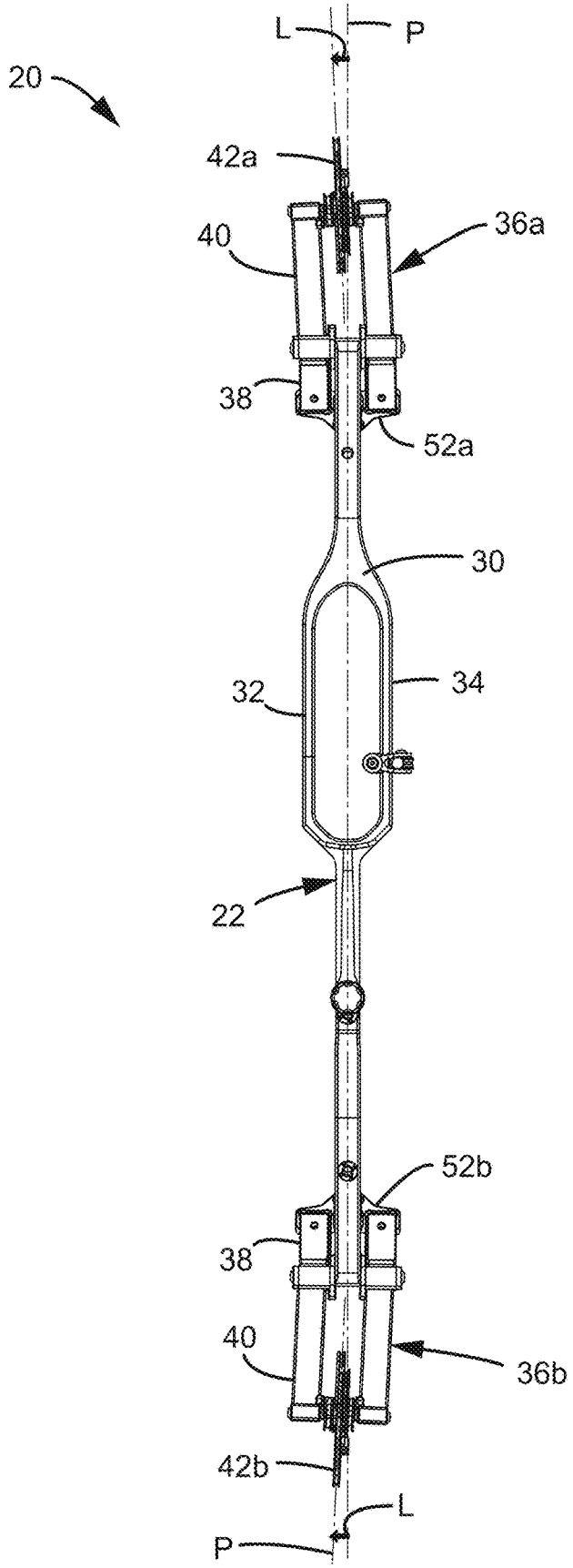
FIG. 8 is a rear view of the compound bow of FIG. 5 prior to the bow being tensioned with the limb pockets of the bow assembled to the riser of the bow in a right handed mounting configuration in which limbs of the bow are angled to compensate for the rightward sideloading which will be applied during tensioning of the bow, the angling of the pockets and limbs is exaggerated for illustration purposes.

When the upper and lower limb pockets 52*a*, 52*b* are mounted to the riser in the right handed mounting configuration as shown at FIG. 8, the base ends 38 of the upper and lower limb arrangements 36*a*, 36*b* are angled in a rightward direction relative to the riser 22 to provide leftward position compensation L (e.g., leftward of the center reference plane P) at the free ends of the upper and lower limb arrangements 36*a*, 36*b*. FIG. 8 shows the bow 20 prior to tensioning of the bow 20 with the leftward position compensation L being adapted to compensate for the rightward sideload 50 applied to the free ends 40 of the upper and lower limb arrangements 36*a*, 36*b* when the bow 20 is tensioned while in the right handed bow configuration. The leftward position compensation L is provided such that upon tensioning of the bow, rightward deflection of the upper and lower limb arrangements 36*a*, 36*b* caused by the rightward sideload 50 brings the bow string 44 into general alignment with the center reference plane P and the centerline of the riser 22 as shown at FIG. 7. It will be appreciated that the angling of the upper and lower limb arrangements 36*a*, 36*b* and the size of the leftward position compensation L are exaggerated as shown at FIG. 8 for illustration purposes. In actual practice, the leftward position compensation L can be in the neighborhood of 0.06 inches.

Figure 9:
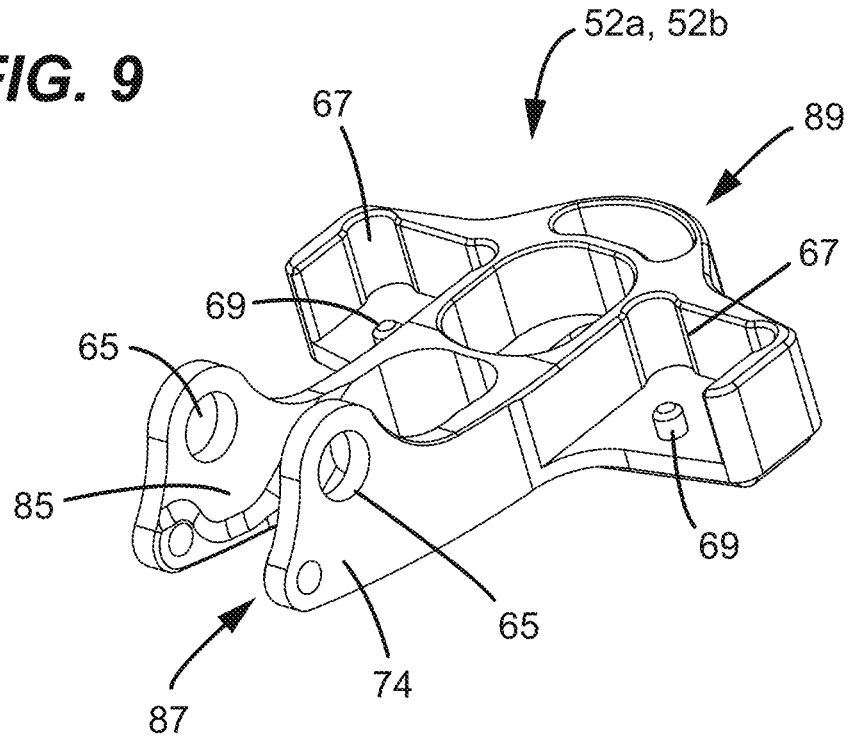
FIG. 9 is a perspective view of one of the limb pockets of the compound bow of FIGS. 1-8.
Figure 10:
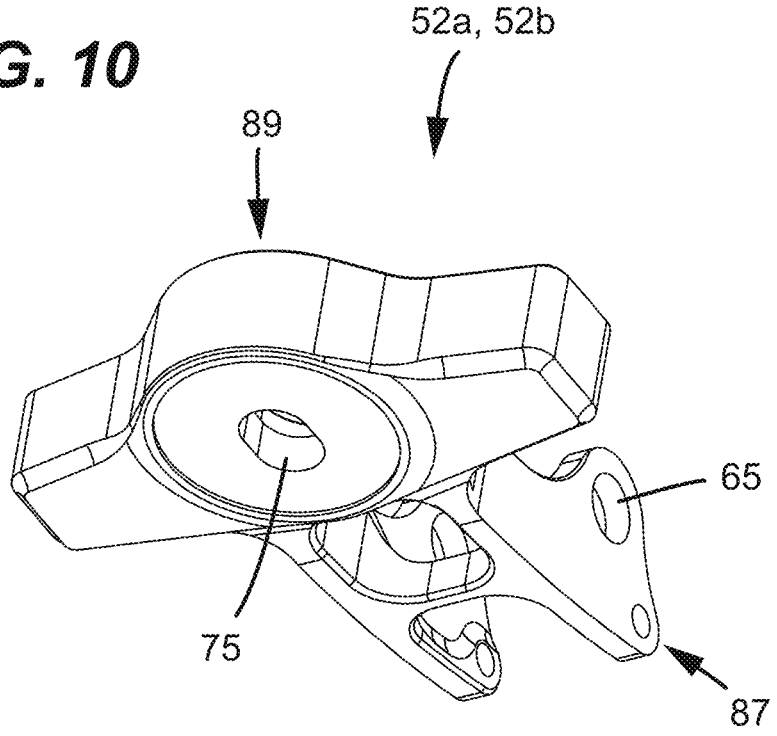
FIG. 10 is another perspective view of the limb pocket of FIG. 9.
Figure 12:
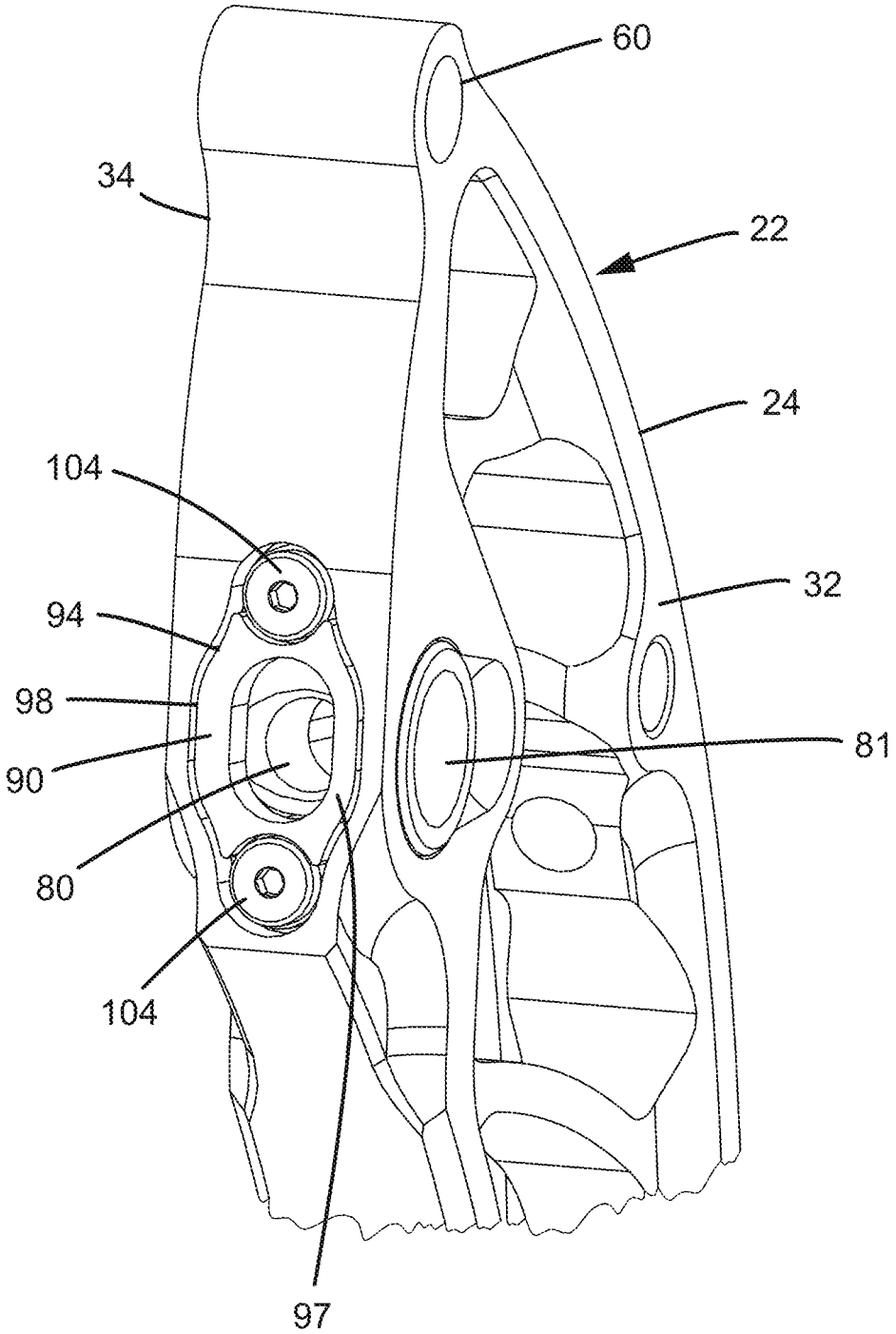
FIG. 12 is a front, left side perspective view of an upper end of the riser of FIG. 1 with a flippable chip mounted to the front of the riser in a first chip mounting configuration corresponding to the left handed bow configuration.
Figure 13:
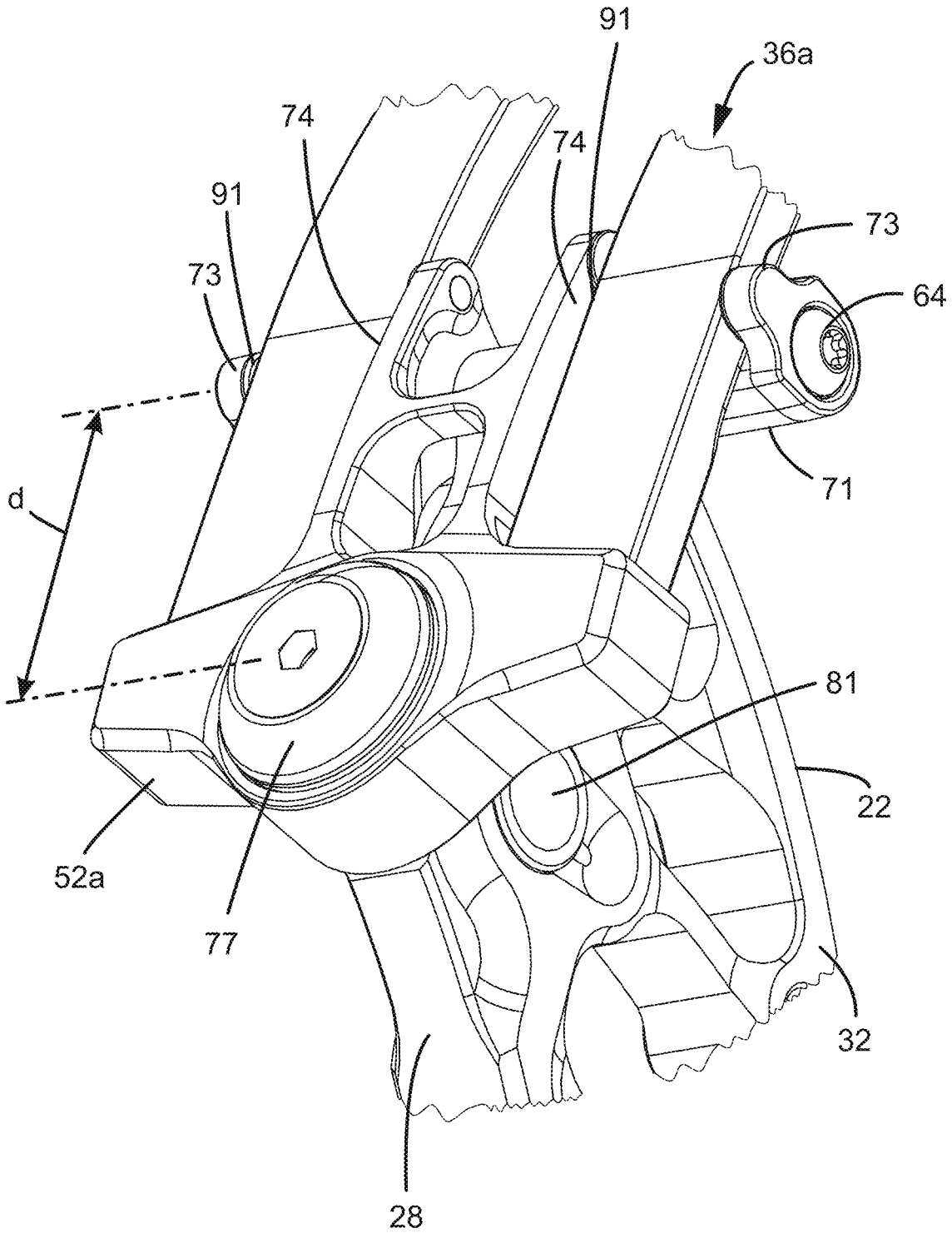
FIG. 13 is a front, left side perspective view showing the upper limb pocket mounting assembly assembled to mount the upper limb pocket to the upper end of the riser in the left handed mounting configuration.
Figure 14:
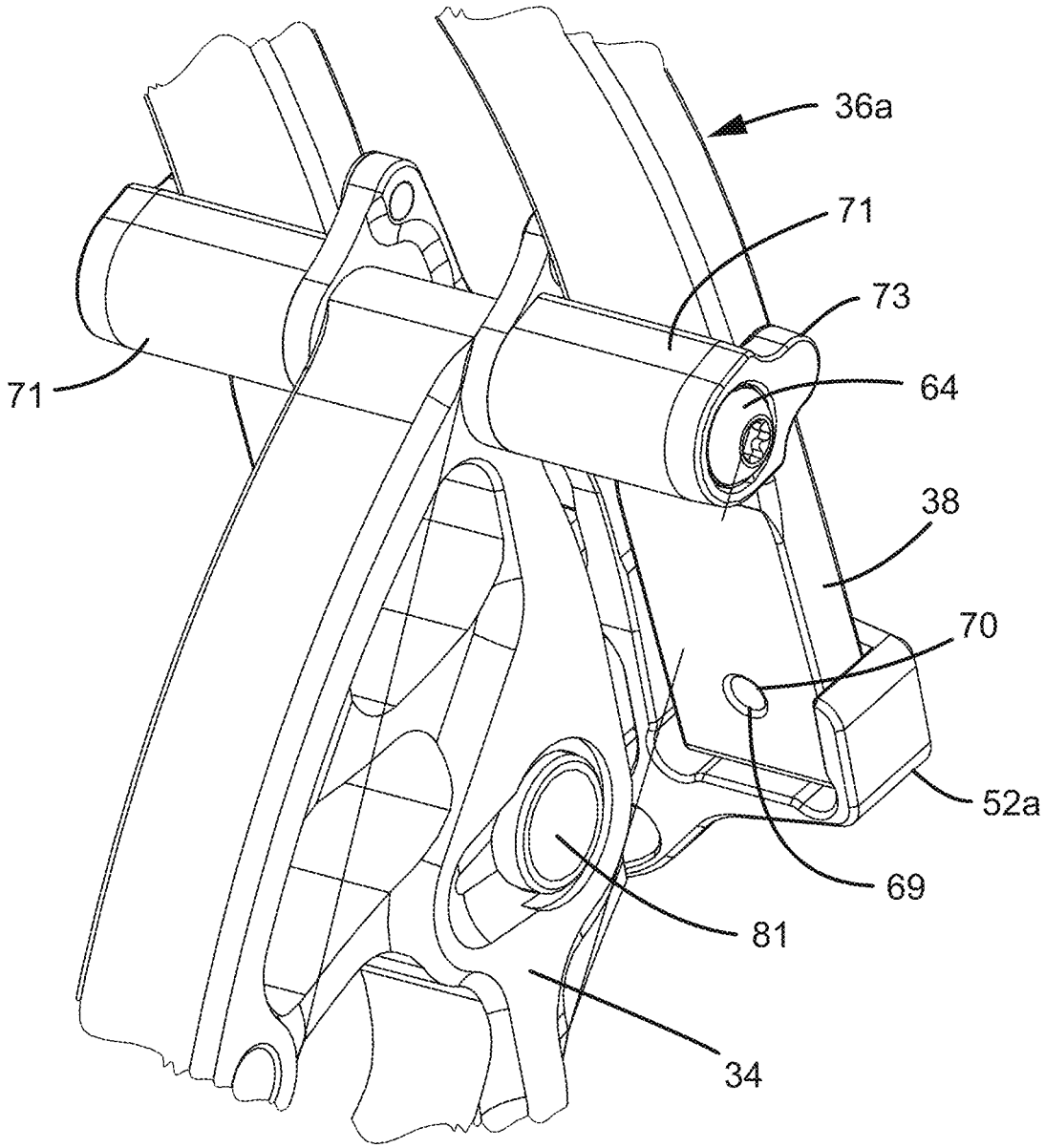
FIG. 14 is a rear, right side perspective view of the upper limb pocket mounting assembly of FIG. 13 assembled to mount the upper limb pocket to the upper end of the riser in the left handed mounting configuration.
Figure 15:
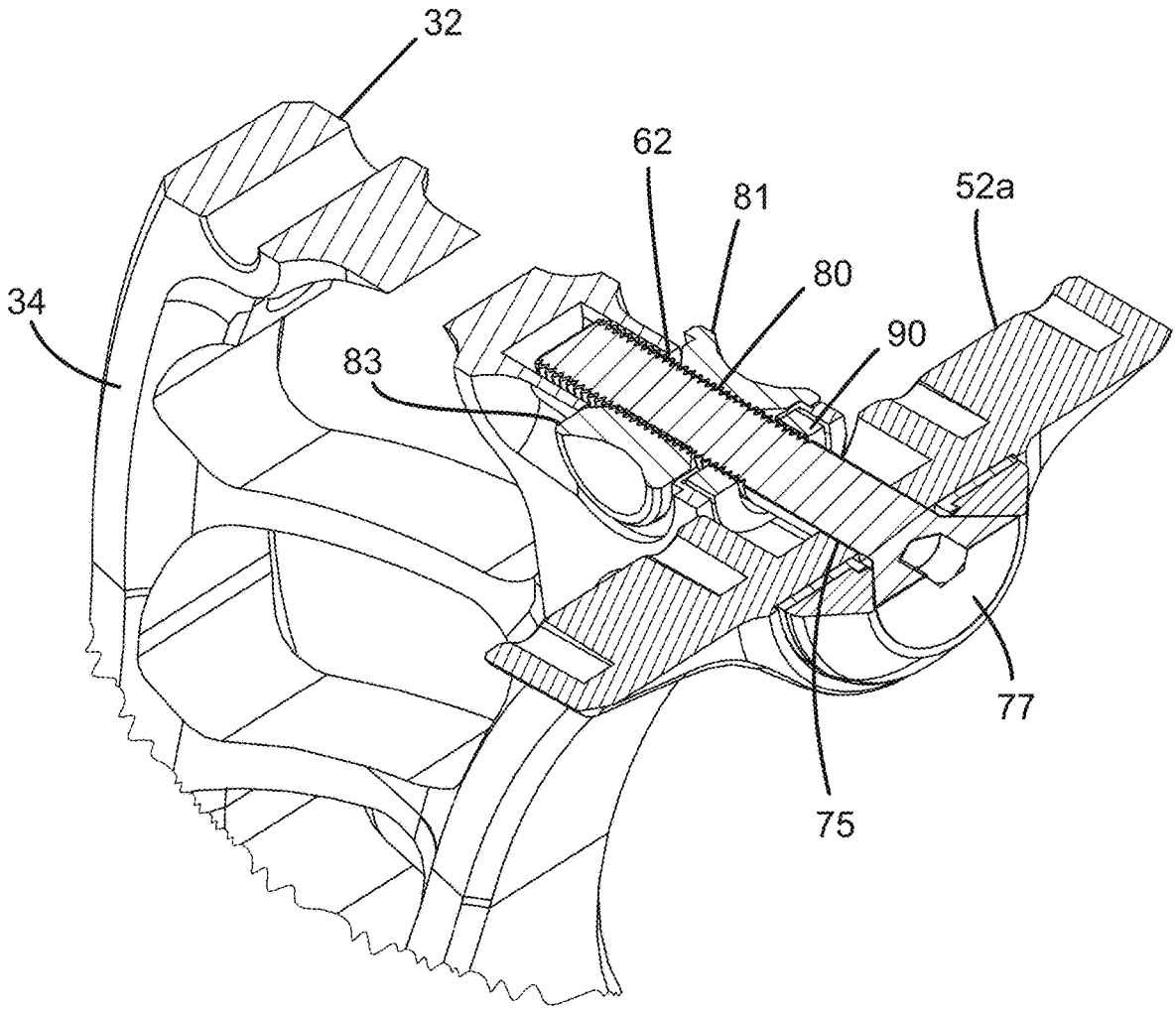
FIG. 15 is a cross-sectional view cut lengthwise through a limb bolt of the upper limb pocket mounting assembly of FIGS. 13 and 14.
Figure 17:
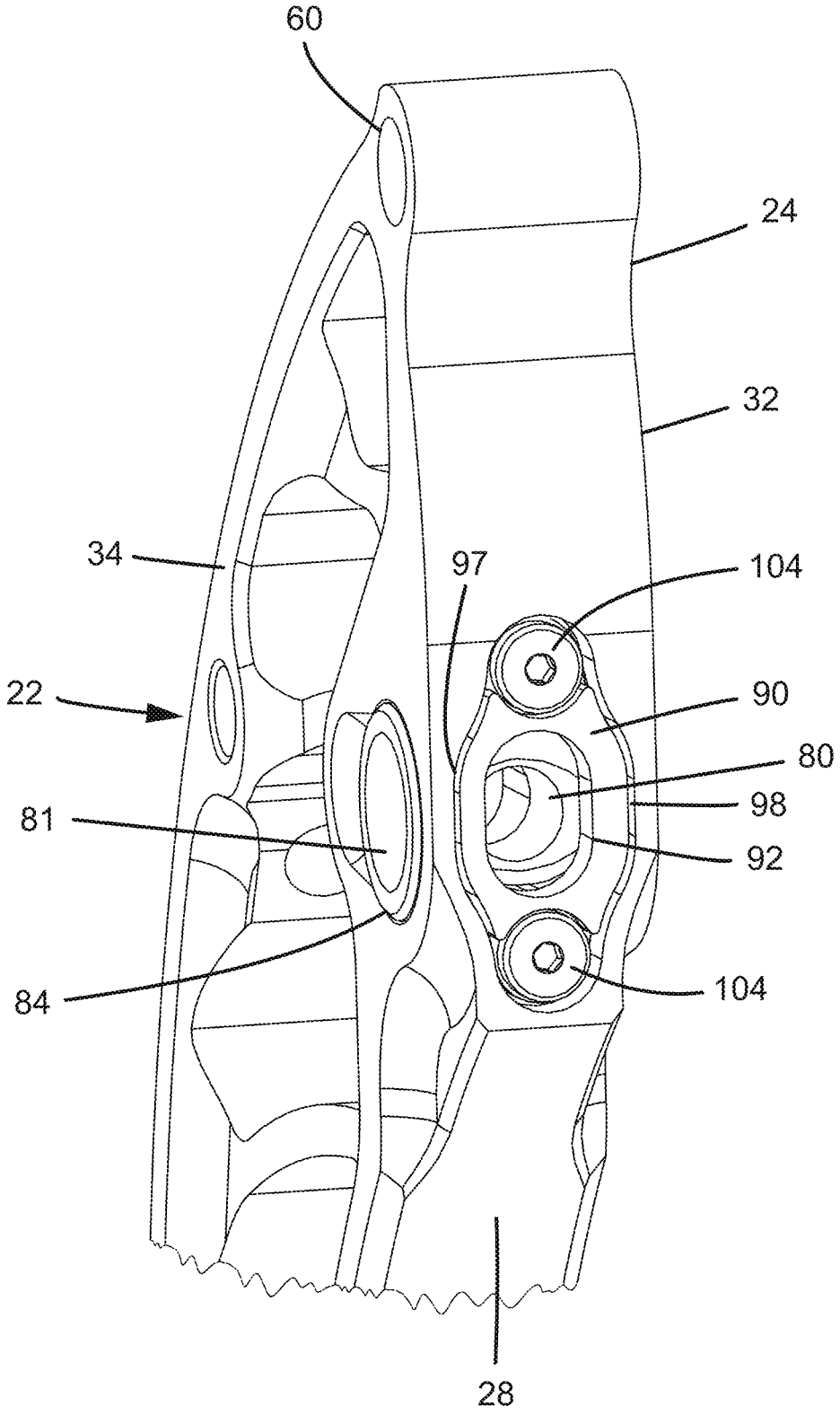
FIG. 17 is a front, right side perspective view of the upper end of the riser of FIG. 5 with the flippable chip mounted to the front of the riser in a second chip mounting configuration corresponding to the right handed bow configuration.
Figure 18:
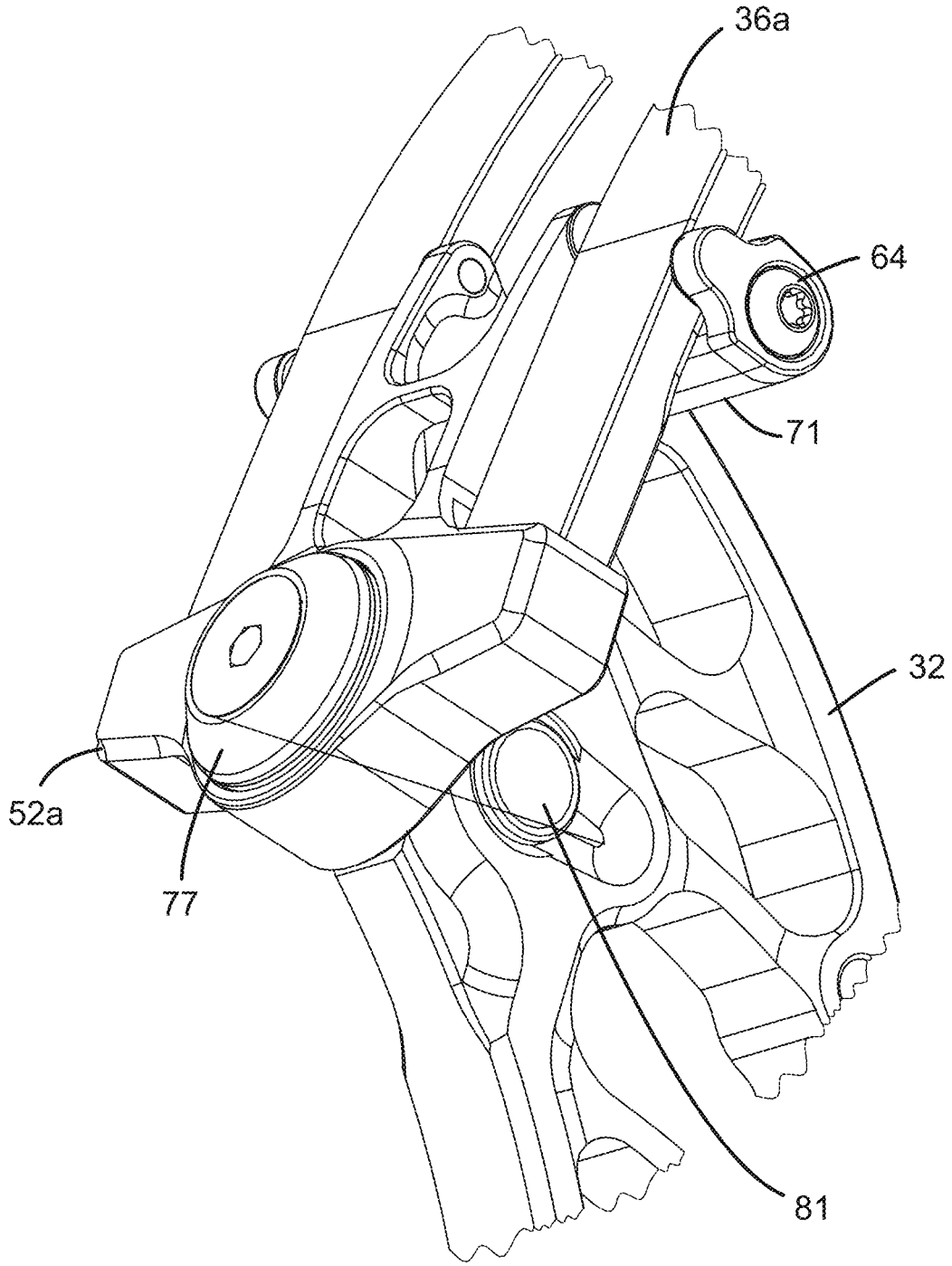
FIG. 18 is a front, left side perspective view showing the upper limb pocket mounting assembly assembled to mount the upper limb pocket to the upper end of the riser in the right handed mounting configuration.
Figure 19:
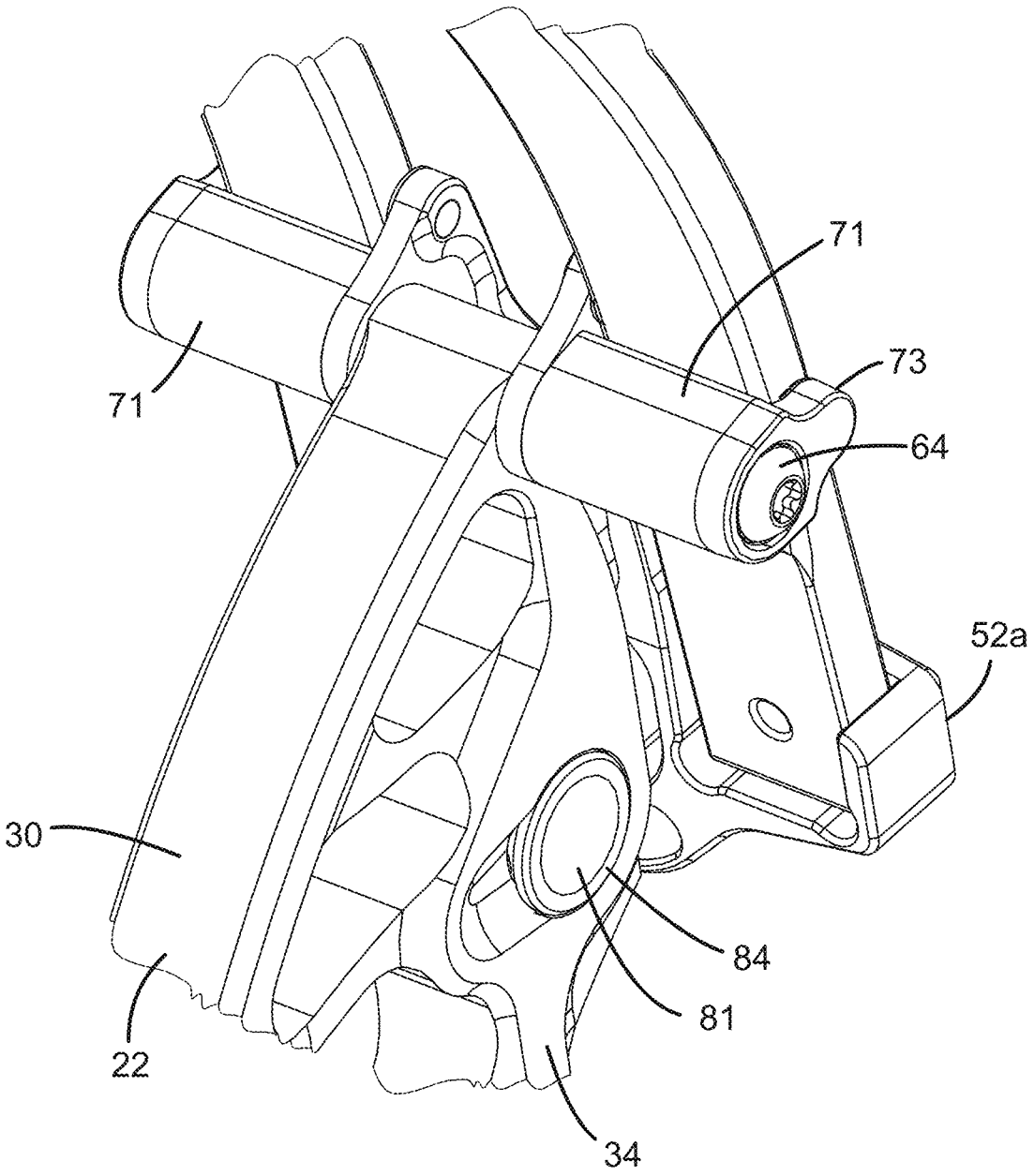
FIG. 19 is a rear, right side perspective view of the upper limb pocket mounting assembly of FIG. 18 assembled to mount the upper limb pocket to the upper end of the riser in the right handed mounting configuration.
Figure 20:
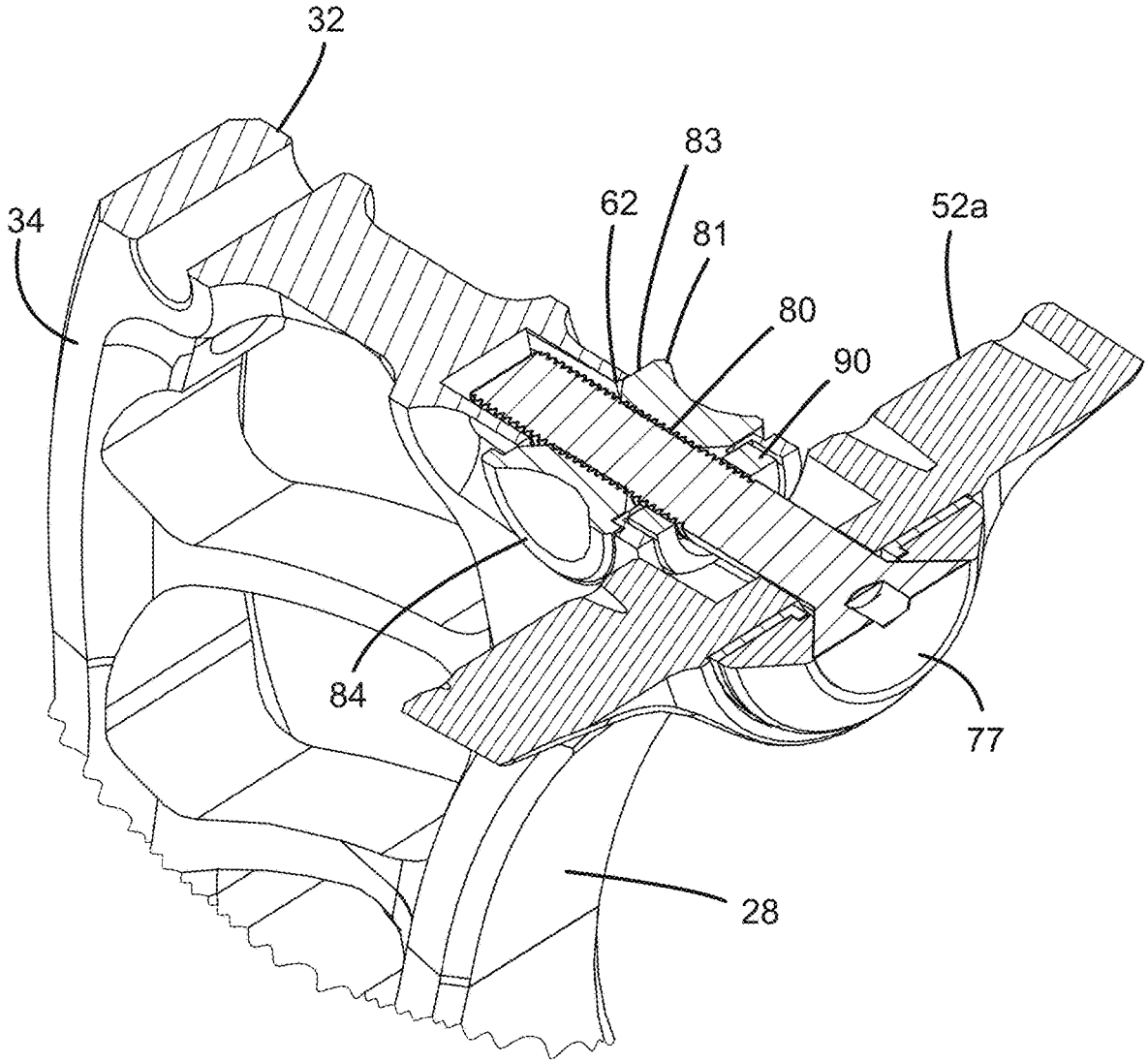
FIG. 20 is a cross-sectional view cut lengthwise through the limb bolt of the upper limb pocket mounting assembly of FIGS. 18 and 19.
Figure 21:
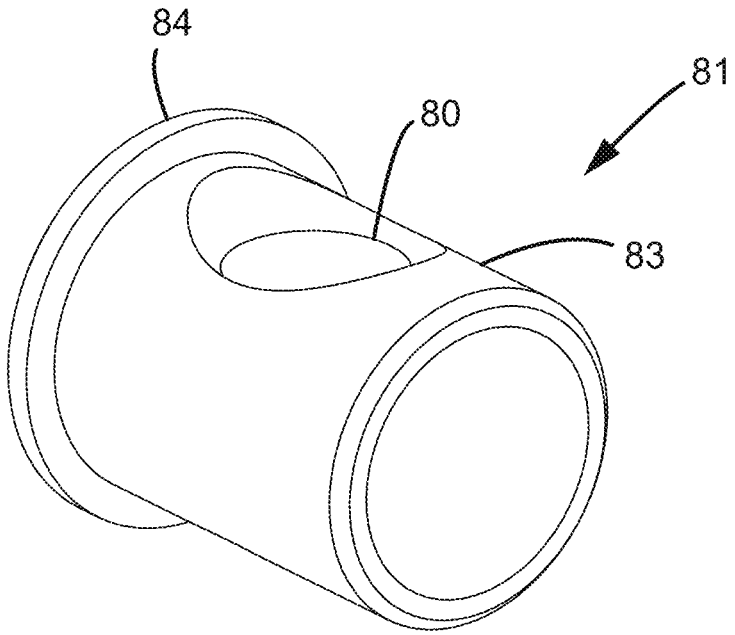
FIG. 21 is a perspective view of an anchor of the upper limb pocket mounting assembly.
Figure 22:
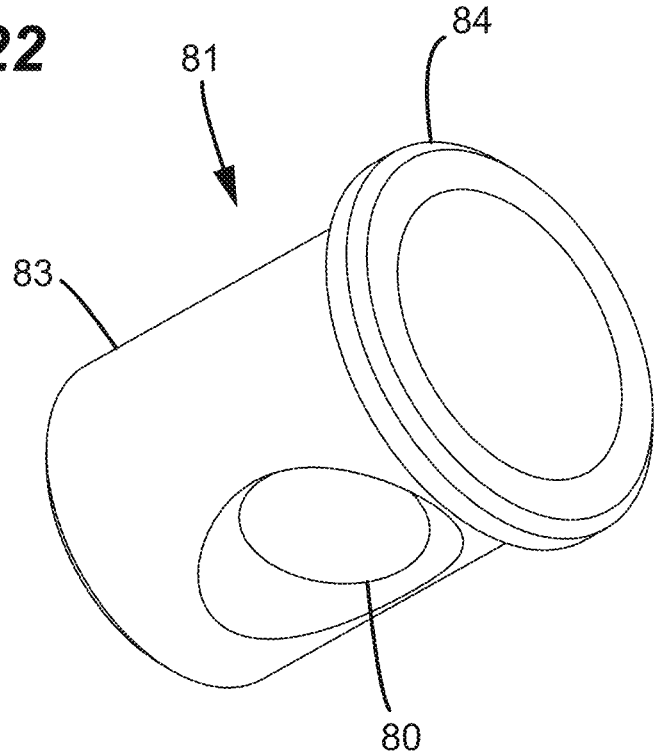
FIG. 22 is another perspective view of the anchor of FIG. 21.
Figure 23:
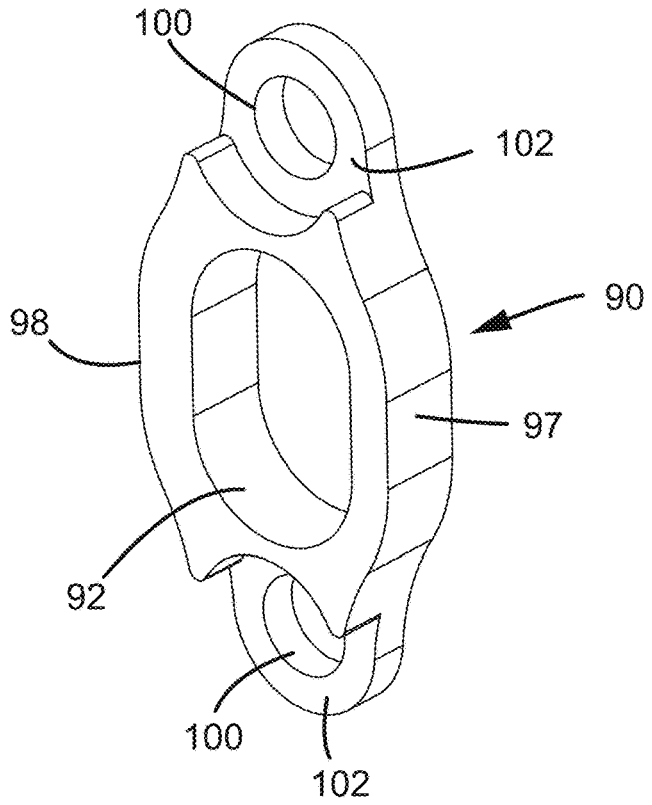
FIG. 23 is a front perspective view of the flippable chip of the upper limb pocket mounting assembly.
Figure 24:
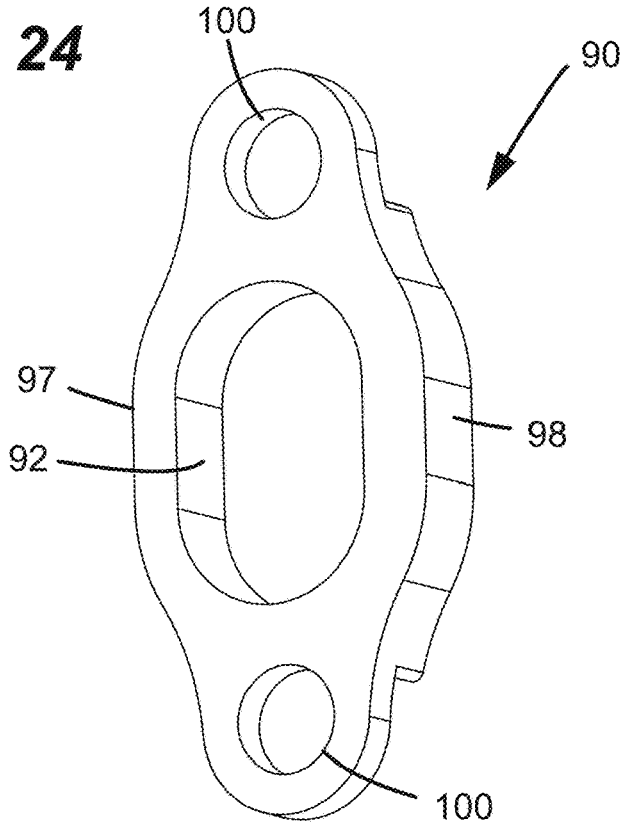
FIG. 24 is a rear perspective view of the flippable chip of the upper limb pocket mounting assembly.
Figure 25:
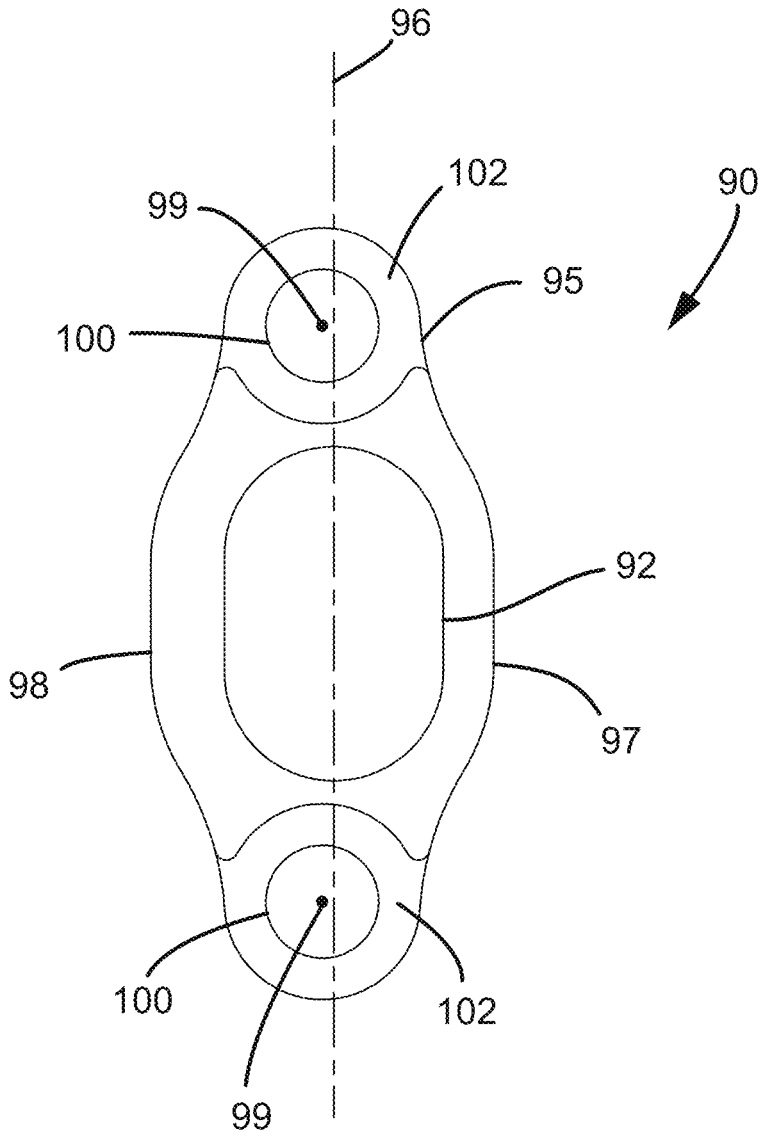
FIG. 25 is a front view of the flippable chip of the upper limb pocket mounting assembly.
Figure 26:
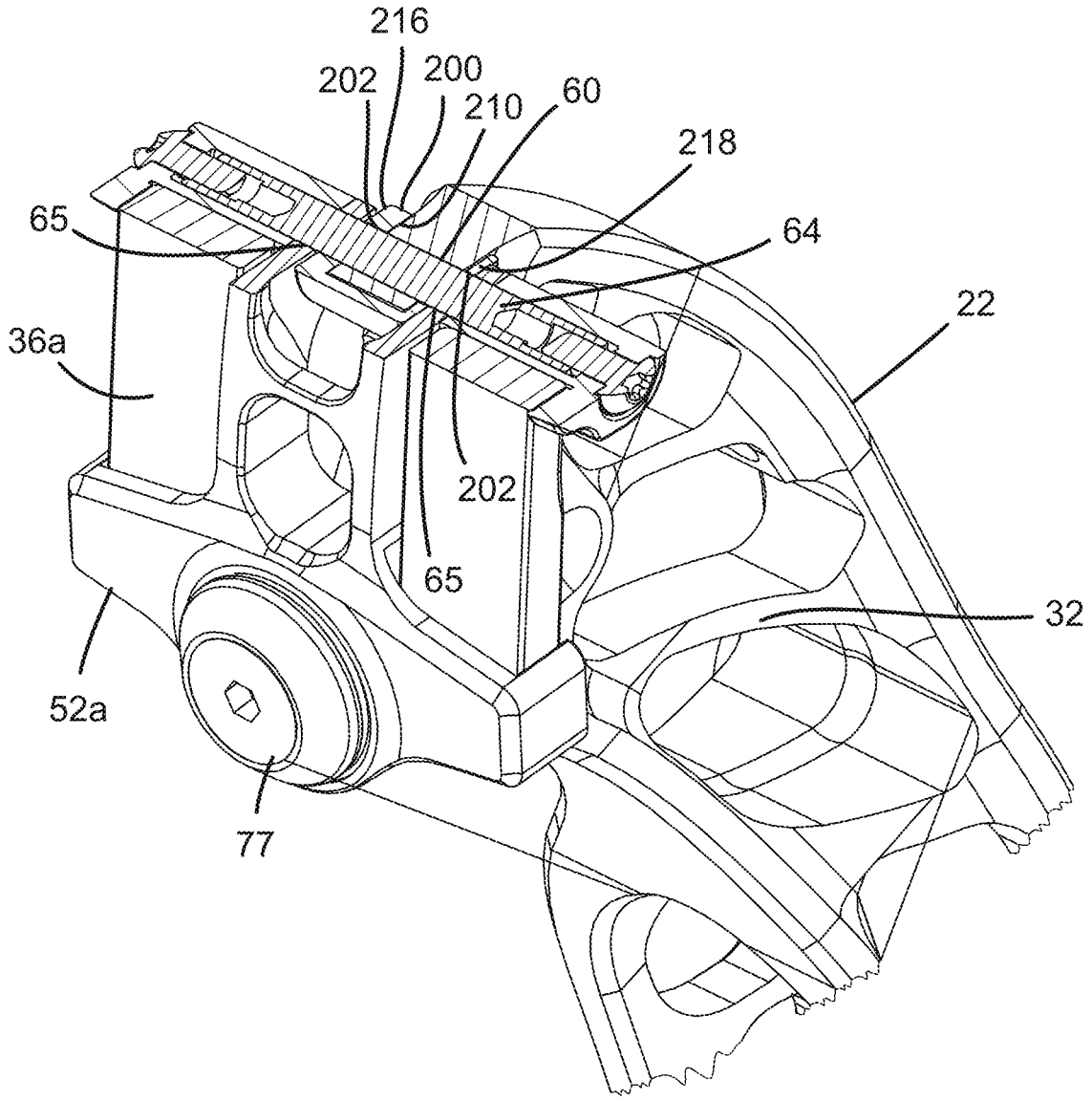
FIG. 26 depicts an alternative limb pocket mounting system assembled in a left handed bow configuration.
Figure 26A:
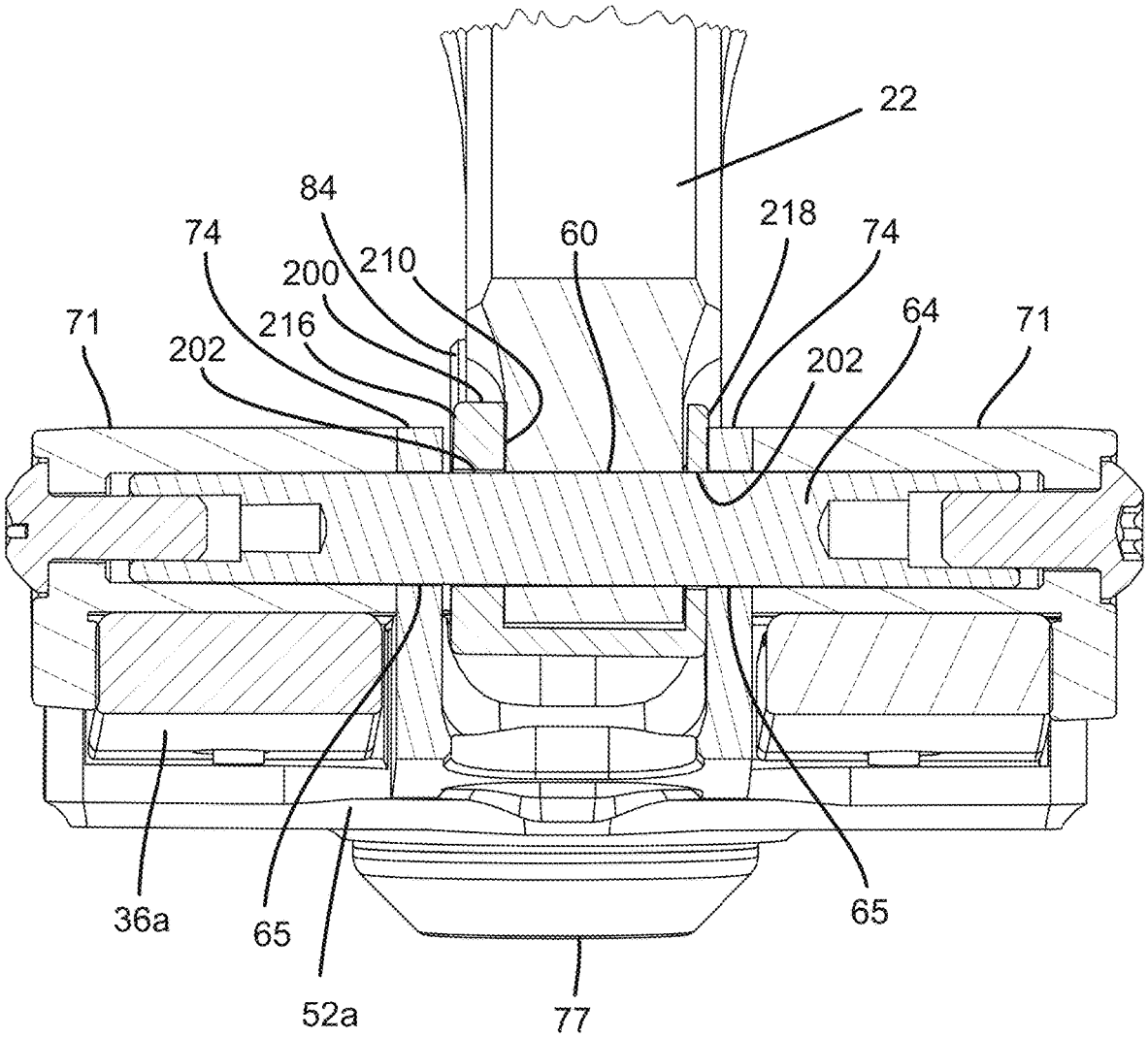
FIG. 26A is an enlarged view of a cross-sectional portion of FIG. 26.
Figure 27:
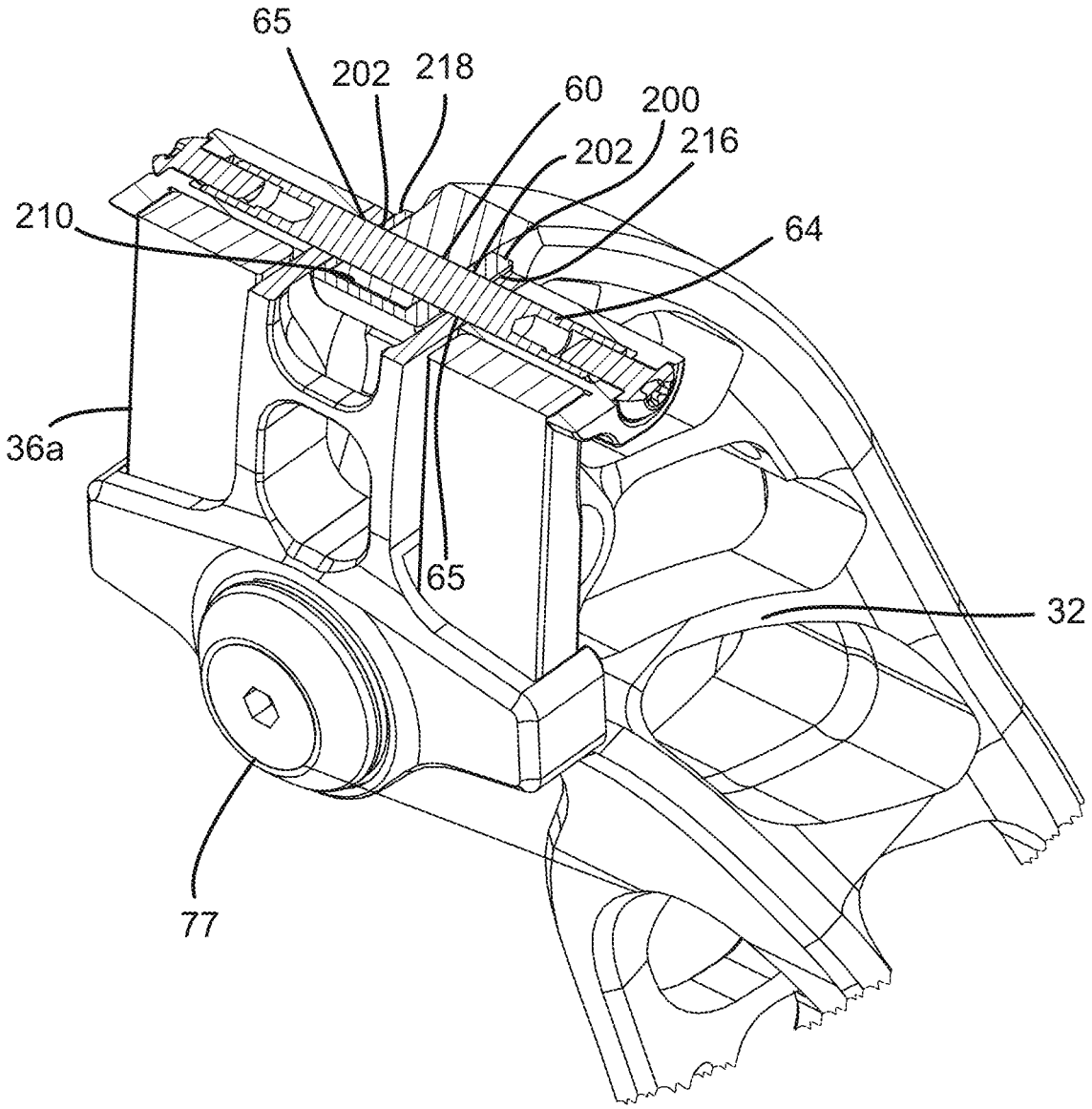
FIG. 27 depicts the limb pocket mounting system of FIG. 26 assembled in a right handed bow configuration.
Figure 27A:
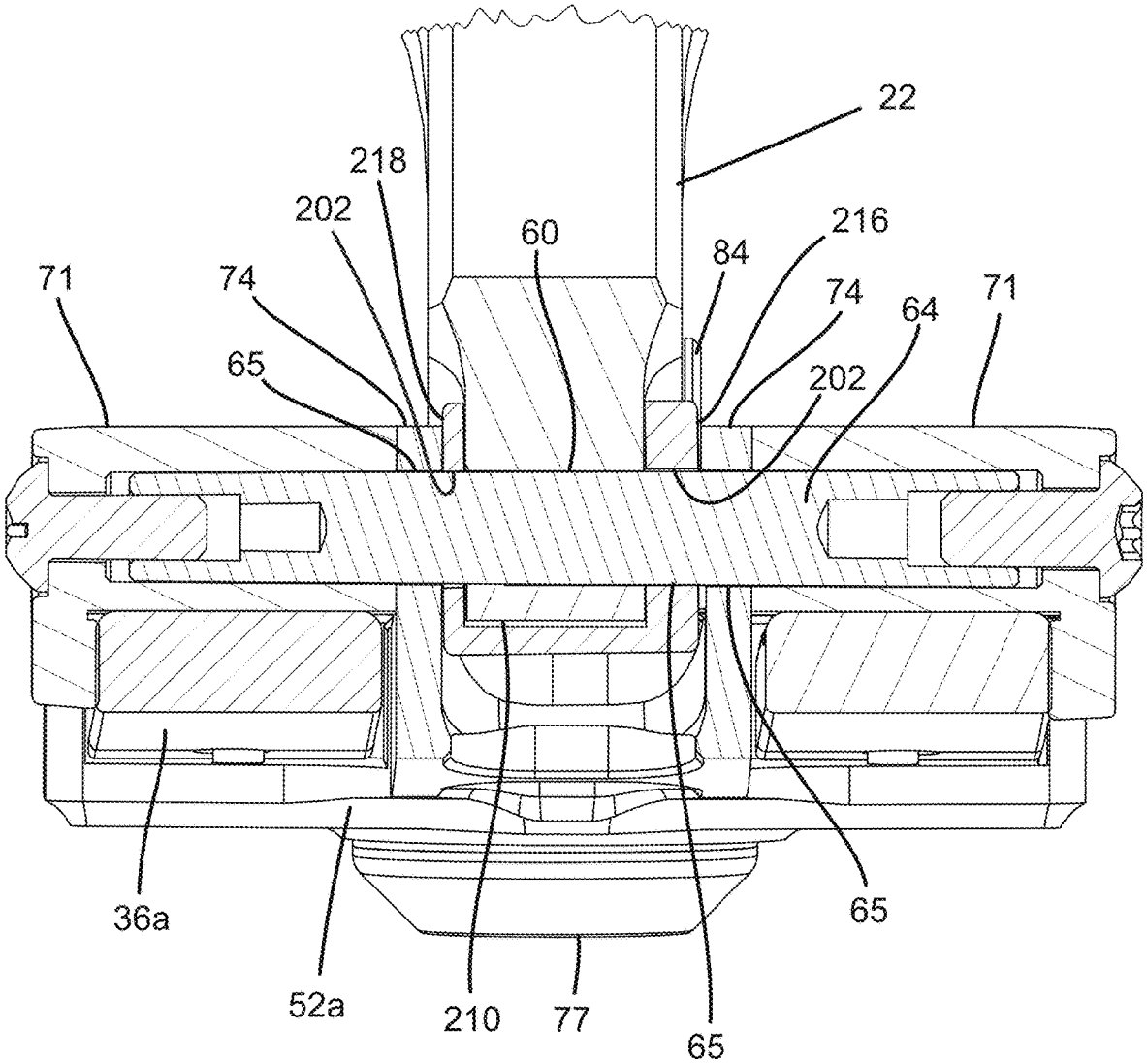
FIG. 27A is an enlarged view of a cross-sectional portion of FIG. 27.

The riser 22 defines an axle opening 60 and an anchor opening 62 adjacent each of the upper and lower ends 24, 26 (the riser axle opening 60 adjacent the upper end 24 is shown at FIGS. 12 and 17 and the anchor opening 62 adjacent the upper end 24 is shown at FIGS. 15 and 20). The axle and anchor openings 60, 62 extend through the riser 22 along a lateral orientation that extends from the left side 32 to the right side 34. The upper and lower limb pockets 52*a*, 52*b* are pivotally connected to the riser by pivot axles 64 (see pivot axle 64 for the upper limb pocket 52*a* of FIGS. 11 and 16). The pivot axles 64 extend through the riser axle openings 60 and through pocket axle openings 65 defined by flanges of the limb pockets 52*a*, 52*b* (see FIGS. 9 and 10). The limb pockets 52*a*, 52*b* define receptacles 67 for receiving the base ends 38 of the limb arrangements 36*a*, 36*b*. Pins 69 that fit within openings 70 at the base ends 38 of the limb arrangements 36*a*, 36*b* can be provided at the receptacles 67. Limb supports 71 can mount on the pivot axles 64 outside the flanges of the limb pockets 52*a*, 52*b*. The limbs extend across the pivot axles 64 in front of the limb supports 71. The limb supports 71 can include tabs 73 that cooperate with walls 74 of the pockets 52*a*, 52*b* to define channels 91 in which the limbs are received. The limb pockets 52*a*, 52*b* also define limb bolt openings 75 (e.g., slots) offset from the pivot axles 64 by a distance d that extends along lengths of the limbs and is transversely oriented relative to pivot axes defined by the pivot axles 64. The limb bolt openings 75 are elongate in an orientation perpendicular to the pivot axes defined by the pivot axles 64. Limb bolts 77 extend through limb bolt openings 75 of the upper and lower limb pockets 52*a*, 52*b*. The limb bolts 77 are used to adjust pivot positions of the upper and lower limb pockets 52*a*, 52*b* about the pivot axes defined by their corresponding pivot axles 64 to adjust a draw weight of the bow 20. The limb bolts 77 mount at the front of the riser 22 and can extend in a forward-to-rearward direction through clearance openings defined by the riser 22 to reach anchors 81 within the anchor openings 62.

The pocket axle openings 65 are defined adjacent an axle end 87 of each limb pocket 52*a*, 52*b* and the limb bolt openings 75 are defined adjacent an opposite limb bolt end 89 of each limb pocket 52*a*, 52*b*. The receptacles 67 are located at the limb bolt end 89 of each pocket and the axle end 87 of each pocket defines a receiving region 85 for receiving a corresponding one of the upper and lower ends of the riser 22 such that the axle end 87 straddles the corresponding end of the riser 22 with the pocket axle openings 65 in co-axial alignment with the riser axle opening 60.

The limb bolts 77 thread within threaded openings 80 defined by the anchors 81 that mount within the anchor openings 62 of the riser 22. Threading the limb bolts 77 into the anchors 81 increases the draw weight while unthreading the limb bolts 77 from the anchor 81 decreases the draw weight. The anchors 81 load into the riser 22 from the left side 32 of the riser 22 to orient the upper and lower limb pockets 52*a*, 52*b* in the left handed mounting configuration (see FIGS. 11-15). The anchors 81 load into the riser 22 from the right side 34 of the riser 22 to orient the upper and lower limb pockets 52*a*, 52*b* in the right handed mounting configuration (see FIGS. 16-20).

Referring to FIGS. 15, 20, 21 and 22, the anchors 81 each include a main body 83 defining the internally threaded opening 80. The anchors 81 also including a flange 84 at one end of the main body 83. Each anchor 81 is mountable within a corresponding one of the anchor openings 62 in a first anchor mounting configuration in which the flange 84 opposes the left side 32 of the riser 22 and a centerline of the internally threaded opening 80 is leftwardly offset from the central reference plane P of the riser 22 (see FIGS. 11-15). Each anchor 81 also is mountable within a corresponding one of the anchor openings 62 in a second anchor mounting configuration in which the flange 84 opposes the right side 34 of the riser 22 and the internally threaded opening 80 is rightwardly offset from the central reference plane P of the riser 22 (see FIGS. 16-20). When the anchors 81 are loaded into the riser 22 from the left side 32 of the riser (as shown at FIGS. 11-15), the anchors are assembled in the first mounting configuration relative to the riser 22 and the threaded opening 80 are positioned closer to the left side 32 of the riser 22 than the right side 34 of the riser 22 to orient the upper and lower limb pockets 52*a*, 52*b* in the left handed mounting configuration. Contact between the flanges 84 and the left side 32 of the riser 22 maintains the threaded openings 80 leftwardly offset from the central reference plane P and closer to the left side 32 of the riser 22. Flexing of the limb pockets 52*a*, 52*b* and play between the limb pockets and the pivot axles 64 allows the limb pockets to angle slightly relative to the riser 22 as the limb bolts 77 are threaded into the anchors 81 to provide the rightward position compensation R provided by assembling the bow 20 in the left handed bow configuration. When the anchors 81 are loaded into the riser 22 from the right side 34 of the riser 22 (as shown at FIGS. 16-20), the anchors 81 are assembled in the second mounting configuration relative to the riser 22 and the threaded openings 80 are positioned closer to the right side 34 of the riser 22 than the left side 32 of the riser 22 to orient the upper and lower limb pockets 52*a*, 52*b* in the right handed mounting configuration. Contact between the flanges 84 and the right side 34 of the riser 22 maintains the threaded openings rightwardly offset from the central reference plane P and closer to the right side 34 of the riser 22. Flexing of the limb pockets 52*a*, 52*b* and play between the limb pockets and the pivot axles 64 allows the limb pockets to angle slightly relative to the riser 22 as the limb bolts 77 are threaded into the anchors 81 to provide the leftward position compensation L provided by assembling the bow 20 in the right handed bow configuration.

Referring to FIGS. 11, 12, 16, 17 and 23-25, the bow 20 also includes chips 90 defining chip slots 92 through which the limb bolts 77 extend. The chips 90 are mountable at the front 28 of the riser 22 in front of the front clearance openings of the riser and preferably within recesses 94. The chip slots 92 are eccentric with respect to outer profiles 95 of the chips 90. For example, referring to FIG. 25, the chip slots 92 have form factors that are elongate along a direction of elongation of the form factor and are bisected by a chip slot centerline 96 that extends along the direction of elongation. The centerline 96 is closer to a first major side 97 of the outer profile of the chip 90 than a second major side 98 of the outer profile of the chip. The centerline 96 is also offset from centers 99 of fastener openings 100 defined at opposite ends of the form factor of the chip 90. Recesses 102 are defined adjacent the fastener openings 100 for accommodating heads of fasteners 104 (e.g., threaded fasteners such as bolts or screws) used to secure the chips 90 to the front side 28 of the riser 22 (e.g., within the recesses 94). The chips 90 are flippable 180 degrees relative to the riser 22 between first chip mounting configurations (see FIGS. 11, 12 and 15) corresponding to the left handed bow configuration and second chip mounting configurations (see FIGS. 16, 17 and 20) corresponding to the right handed bow configuration. The centerlines 96 of the chip slots 92 are leftwardly offset from the central reference plane P and positioned closer to the left side 32 of the riser 22 than the right side 34 of the riser 22 when the chips 90 are in the first chip mounting configurations. The centerlines 96 of the chip slots 92 are rightwardly offset from the central reference plane P and positioned closer to the right side 34 of the riser 22 than the left side 32 of the riser 22 when the chips 90 are in the second chip mounting configurations.

FIGS. 26, 26A, 27 and 27A show an alternative embodiment where the limb bolts remain centered on the central reference plane P, and spacers 200 are used to laterally shift the positions of the axle ends of the limb pockets 52*a*, 52*b* relative to the central reference plane P of the riser 22 to change between the left handed bow configuration and the right handed bow configuration. The spacers 200 mount at the upper and lower ends of the riser 24, 26 and include axle openings 202 that align with the riser axle openings 60. The spacers 200 each define riser receptacles 210 adapted to receive upper or lower ends of the riser 24, 26. The spacers 200 also include side walls that define the axle openings 202. The spacer axle openings 202 are adapted to co-axially align with the riser axle openings 60 when the ends of riser 24, 26 are received within the riser receptacles 210. The pocket axle openings 65 also co-axially align with the spacer axle openings 202, limb supports 71 mount outside the walls of the pockets 52*a*, 52*b* defining the pocket axle openings 65 and spacers 200 mount between the walls 74. The side walls 74 have lateral facing surfaces 216, 218 that are straddled by the axle ends of the pockets 52*a*, 52*b* when the pockets 52*a*, 52*b* are mounted to the riser 22 using the spacers 200. The riser receptacle 210 is not centered between the lateral facing surfaces 216, 218 such that one of the lateral facing surfaces 216 is axially further from a center of the receptacle 210 than the other of the lateral facing surface 218. Pivot axles 64 extend through spacer axle openings 202 as well as the riser axle openings 60 and the pocket axle openings 65, pivotally attach the pockets 52*a*, 52*b* to the ends of the riser 22. The spacers 200 are configured to offset the axle ends of the limb pockets 52*a*, 52*b* toward the right side 34 of the riser 22 (see FIGS. 26 and 26A) for the left handed bow configuration and are configured to offset the axle ends of the limb pockets 52*a*, 52*b* toward the left side 32 of the riser 22 (see FIGS. 27 and 27A) for the right handed bow configuration. When the spacer is in the left handed configuration of FIGS. 26 and 26A, rightward lateral position compensation R is provided to compensate for the left sideload 48 that exists on the limbs when the bow is in the left handed bow configuration. When the spacer is in the right handed configuration of FIGS. 27 and 27A, left lateral position compensation L is provided to compensate for the right sideload 50 that exists on the limbs when the bow is in the right handed bow configuration.

It should be appreciated the above description is not meant to be limiting. The above description relates to several embodiments of the invention. Many other embodiments are possible.

We claim:

1. A bow comprising:

a riser having an upper end and a lower end, the riser also including a front side and rear side, the riser further including a left side and a right side;

upper and lower limb arrangements having base ends and free ends, the base ends of the upper limb arrangement attaching to the upper end of the riser and the base ends of the lower limb arrangement attaching to the lower end of the riser;

an upper cam supported by the free ends of the upper limb arrangement and a lower cam supported by the free ends of the lower limb arrangement, wherein the upper and lower cams are configured to engage a bow string and tensioning cables;

the bow being configurable in a left handed bow configuration and a right handed bow configuration, wherein when the bow is configured in the left handed bow configuration the tensioning cables and the upper and lower cams apply a leftward sideload to the free ends of the upper and lower limb arrangements when the bow is tensioned, and wherein when the bow is configured in the right handed bow configuration the tensioning cables and the upper and lower cams apply a rightward sideload to the free ends of the upper and lower limb arrangements when the bow is tensioned; and upper and lower limb pockets that respectively mount to the upper and lower ends of the riser for attaching the base ends of the upper and lower limb arrangements to the upper and lower ends of the riser, the upper and lower limb pockets each being mountable to the riser in a left handed mounting configuration when the bow is set in the left handed bow configuration and a right handed mounting configuration when the bow is set in the right handed bow configuration, wherein when the upper and lower limb pockets are mounted to the riser in the left handed mounting configuration the base ends of the upper and lower limb arrangements are angled in a leftward direction relative to the riser to provide rightward position compensation at the free ends of the upper and lower limb arrangements that compensates for the leftward sideload applied to the free ends of the upper and lower limb arrangements when the bow is tensioned while in the left handed bow configuration, and wherein when the upper and lower limb pockets are mounted to the riser in the right handed mounting configuration the base ends of the upper and lower limb arrangements are angled in a rightward direction relative to the riser to provide leftward position compensation at the free ends of the upper and lower limb arrangements that compensates for the rightward sideload applied to the free ends of the upper and lower limb arrangements when the bow is tensioned while in the right handed bow configuration.

2. The bow of claim 1, wherein the upper and lower limb pockets are pivotally connected to the riser by pivot axles, wherein limb bolts extending through limb bolt openings of the upper and lower limb pockets are used to adjust pivot positions of the upper and lower limb pockets about their corresponding pivot axles to adjust a draw weight of the bow.

3. The bow of claim 2, wherein the limb bolts and the limb bolt openings are positioned closer to the left side of the riser than the right side of the riser to orient the upper and lower limb pockets in the left handed mounting configuration relative to the riser, and wherein the limb bolts and the limb bolt openings are positioned closer to the right side of the riser than the left side of the riser to orient the upper and lower limb pockets in the right handed mounting configuration relative to the riser.

4. The bow of claim 3, wherein the limb bolts thread within threaded openings defined by anchors that mount within the riser, wherein the anchors load into the riser from the left side of the riser to orient the upper and lower limb pockets in the left handed mounting configuration, and wherein the anchors load into the riser from the right side of the riser to orient the upper and lower limb pockets in the right handed mounting configuration.

5. The bow of claim 3, wherein the limb bolts thread within threaded openings defined by anchors that mount within the riser, wherein when the anchors are loaded into the riser from the left side of the riser the threaded opening are positioned closer to the left side of the riser than the right side of the riser to orient the upper and lower limb pockets in the left handed mounting configuration, and wherein when the anchors are loaded into the riser from the right side of the riser the threaded opening are positioned closer to the right side of the riser than the left side of the riser to orient the upper and lower limb pockets in the right handed mounting configuration.

6. The bow of claim 3, wherein the bow includes chips defining chip slots through which the limb bolts extends, the chips being mountable at the front of the riser, the chips being flippable 180 degrees relative to the riser between first chip mounting configurations corresponding to the left handed bow configuration and second chip mounting configurations corresponding to the right handed bow configuration, wherein centerlines of the chip slots are positioned closer to the left side of the riser than the right side of the riser when the chips are in the first chip mounting configurations, and wherein the centerlines of the chip slots are positioned closer to the right side of the riser than the left side of the riser when the chips are in the second chip mounting configurations.

7. The bow of claim 6, wherein the chips mount within recesses defined at the front side of the riser.

8. The bow of claim 1, wherein the riser is a shoot-though handle, wherein the rightward position compensation overcomes the effect of the leftward sideload to center the bow string relative to the riser when the bow is set in the left handed bow configuration, and wherein leftward position compensation overcomes the effect of the rightward sideload to center the bow string relative to the riser when the bow is set in the right handed bow configuration.

9. The bow of claim 1, wherein the upper and lower limb pockets are pivotally connected to the riser by pivot axles, wherein limb bolts extending through limb bolt openings of the upper and lower limb pockets are used to adjust pivot positions of the upper and lower limb pockets about their corresponding pivot axles to adjust a draw weight of the bow, and spacers mounted to the upper and lower ends of the riser at the pivot axles are used to selectively mount the upper and lower limb pockets to the riser in the left handed mounting configuration and the right handed mounting configuration.

10. The bow of claim 9, wherein the spacers can be flipped relative to the riser between first positions corresponding to the left handed mounting configuration and second positions corresponding to the right handed mounting configuration.

11. A bow comprising:

a riser having an upper end and a lower end, the riser also including a front side and rear side, the riser further including a left side and a right side, the riser defining an anchor opening that extends through the riser along a lateral orientation that extends from the left side to the right side, the riser being bisected by a central reference plane that intersects the front and rear sides and is centered between the left and right sides;

upper limbs having base ends that attach to the upper end of the riser and free ends at which a cam is mounted for engaging a bow string;

an upper limb pocket that mounts to the upper end of the riser for attaching the upper limbs to the upper end of the riser, the upper limb pocket being configured to receive the base ends of the upper limbs;

a pivot axle that extends through the riser along the lateral orientation, the pivot axle being configured for pivotally connecting the upper limb pocket to the riser and for allowing pivotal movement of the upper limb pocket relative to the riser to adjust a draw weight of the bow, the upper limb pocket defining a limb bolt opening that is downwardly offset from the pivot axle;

an anchor that mounts in the anchor opening, the anchor including a main body defining an internally threaded opening, the anchor also including a flange at one end of the main body, the anchor being mountable within the anchor opening in a first anchor mounting configuration in which the flange opposes the left side of the riser and a centerline of the internally threaded opening is leftwardly offset from the central reference plane of the riser, the anchor also being mountable within the anchor opening in a second anchor mounting configuration in which the flange opposes the right side of the riser and the internally threaded opening is rightwardly offset from the central reference plane of the riser;

a limb bolt that extends through the limb bolt opening of the upper limb pocket and threads into the threaded opening of the anchor for setting a pivot position of upper limb pocket about the pivot axis, wherein the anchor is mounted in the first anchor mounting configuration when it is desired to set the bow in a left handed bow configuration, and wherein the anchor is mounted in the second anchor mounting configuration when it is desired to set the bow in a right handed bow configuration.

12. The bow of claim 11, wherein the riser is a shoot-though handle, wherein when the anchor is mounted in the first anchor mounting configuration the anchor is adapted to offset a centerline of the limb bolt leftward of the central reference plane of the riser thereby causing a center of the limb bolt opening to also be leftwardly offset with respect to the central reference plane of the riser, and wherein when the anchor is mounted in the second anchor mounting configuration the anchor is adapted to offset the centerline of the limb bolt rightward of the central reference plane of the riser thereby causing the center of the limb bolt opening to also be rightwardly offset with respect to the central reference plane of the riser.

13. The bow of claim 11, wherein the riser defines a front clearance slot through which the limb bolt extends to reach the anchor within the anchor opening.

14. The bow of claim 11, wherein the bow includes a chip defining a chip slot through which the limb bolts extends, the chip being mountable at the front of the riser, the chip being flippable relative to the riser between a first chip mounting configuration corresponding to the left handed bow configuration and a second chip mounting configuration corresponding to the right handed bow configuration, wherein centerline of the chip slot is leftwardly offset from the central reference plane of the riser when the chip is in the first chip mounting configuration, and wherein the centerline of the chip slot is rightwardly offset from the central reference plane of the riser when the chip is in the second chip mounting configuration.

15. The bow of claim 14, wherein the chip is secured to the front of the riser by fasteners threaded into fastener openings of the riser.

16. The bow of claim 14, wherein the chip mounts within a chip recesses defined at the front side of the riser.

17. The bow of claim 16, wherein the chip is secured within the recess by fasteners threaded into fastener openings of the riser.

* * * * *